US008609210B2

(12) United States Patent
Nagoshi et al.

(10) Patent No.: US 8,609,210 B2
(45) Date of Patent: Dec. 17, 2013

(54) COATED PRINTING PAPER

(75) Inventors: Masanori Nagoshi, Tokyo (JP); Koji Idei, Tokyo (JP); Hiroshi Matsuda, Tokyo (JP); Kazutoshi Iida, Tokyo (JP); Jun Urasaki, Tokyo (JP)

(73) Assignee: Mitsubishi Paper Mills Limited, Tokyo (JP)

( * ) Notice: Subject to any disclaimer, the term of this patent is extended or adjusted under 35 U.S.C. 154(b) by 42 days.

(21) Appl. No.: 13/383,958

(22) PCT Filed: Jul. 13, 2010

(86) PCT No.: PCT/JP2010/061832

§ 371 (c)(1),
(2), (4) Date: Jan. 13, 2012

(87) PCT Pub. No.: WO2011/007775

PCT Pub. Date: Jan. 20, 2011

(65) Prior Publication Data

US 2012/0114880 A1 May 10, 2012

(30) Foreign Application Priority Data

| | | |
|---|---|---|
| Jul. 17, 2009 | (JP) | 2009-169533 |
| Oct. 2, 2009 | (JP) | 2009-230691 |
| Oct. 2, 2009 | (JP) | 2009-230692 |
| Feb. 2, 2010 | (JP) | 2010-021212 |
| Feb. 10, 2010 | (JP) | 2010-027144 |
| Mar. 25, 2010 | (JP) | 2010-070675 |

(51) Int. Cl.

| | |
|---|---|
| ***B41M 5/00*** | (2006.01) |
| ***B41M 5/52*** | (2006.01) |
| ***B41M 5/50*** | (2006.01) |

(52) U.S. Cl.

CPC ..... *B41M 5/5218* (2013.01); *B41M 5/52* (2013.01); *B41M 5/506* (2013.01); *B41M 5/5254* (2013.01); *B41M 5/508* (2013.01)

USPC ..... 428/32.21; 428/32.24; 428/32.25; 428/32.34; 428/32.37

(58) Field of Classification Search

CPC ..... B41M 5/5218; B41M 5/52; B41M 5/506; B41M 5/5254; B41M 5/508

USPC ..... 428/32.21, 32.24, 32.25, 32.34, 32.37

See application file for complete search history.

(56) References Cited

U.S. PATENT DOCUMENTS

| | | | | |
|---|---|---|---|---|
| 2004/0058145 | A1* | 3/2004 | Kasamatsu et al. | 428/323 |
| 2004/0077781 | A1* | 4/2004 | Murase et al. | 524/800 |
| 2008/0160232 | A1* | 7/2008 | Sasaguri et al. | 428/32.33 |
| 2009/0126584 | A1 | 5/2009 | Nakano | |
| 2012/0114880 | A1* | 5/2012 | Nagoshi et al. | 428/32.33 |

FOREIGN PATENT DOCUMENTS

| | | | |
|---|---|---|---|
| JP | 2002-347328 | A | 12/2002 |
| JP | 2005-88482 | A | 4/2005 |
| JP | 2005-153221 | A | 6/2005 |
| JP | 2006-218669 | A | 8/2006 |
| JP | 2007-83681 | A | 4/2007 |
| JP | 2007-118289 | A | 5/2007 |
| JP | 2007-185780 | A | 7/2007 |
| JP | 2009-23292 | A | 2/2009 |
| JP | 2009-96016 | A | 5/2009 |
| JP | 2009-125947 | A | 6/2009 |

* cited by examiner

*Primary Examiner* — Betelhem Shewareged
(74) *Attorney, Agent, or Firm* — Birch, Stewart, Kolasch & Birch, LLP

(57) ABSTRACT

The object of the present invention is to provide a coated printing paper used for ink jet printing machines, which has an ink fixing property and ink absorption property corresponding to ink jet printing, which inhibits poor dot diffusion, and which is excellent in abrasion resistance property of printed portions. According to the present invention, provided is a coated printing paper comprising a base paper, an undercoating layer which is applied on at least one surface of the base paper and contains a pigment and a binder, and one or more coating layers on the undercoating layer, wherein the base paper contains at least one selected from a cationic resin and a multivalent cation salt; the uppermost coating layer contains at least a colloidal silica; and the 75° gloss according to JIS Z8741 of the surface of the uppermost coating layer is 40% or more.

4 Claims, No Drawings

COATED PRINTING PAPER

TECHNICAL FIELD

The present invention relates to a coated printing paper to be used in a printing machine employing ink jet recording system. Specifically, the invention relates to a coated printing paper with gloss.

BACKGROUND ART

Due to rapid development in ink jet recording technology, it has become possible to form a colored and high quality image on a recording medium such as paper and film by printers using ink jet recording system. Such printers using ink jet recording system vary from small size printers for home use to wide-format printers used by printing companies and so forth. Since printing is basically performed on a one sheet-by-one sheet basis, these printers were mainly used at printing sites where a small number of copies was required.

In recent years, because of further development of the technology, application of ink jet recording system to commercial printing (hereinafter referred to as "ink jet printing") has been started. In the commercial printing field, the number of copies to be printed is large and in the light of the balance between productivity and printing cost, printing speed is valued. Printing speed suitable for ink jet printing is achieved by a printing machine comprising a line scan head to which heads for ejecting ink are fixed such that they cover the entire cross direction intersecting at right angles with the machine direction (hereinafter referred to as "ink jet printing machine") (see, for example, Patent Document 1). Recently, rotary-type ink jet printing machines have also been developed. And rotary-type ink jet printing machines with a printing speed of 15 m/min or more, those with a higher speed of 60 m/min or more, and those with a speed exceeding 120 m/min have been developed.

Since ink jet printing machines can deal with variable information, they are applied particularly to on-demand printing. It is preferred that fixed information be printed by an offset printing machine, and variable information be printed by an ink jet printing machine in commercial printing.

PPC paper or non-coated paper has conventionally been used as paper for ink jet printing machine. There is a demand, however, for coated printing paper which has a texture similar to that of general-purpose coated printing paper such as CWF matt coated paper and CWF gloss coated paper, and can be used for ink jet printing machines in order to meet the increasing demand for high definition and high quality commercial printing.

In view of weather resistance, ink jet printing machines which use pigment ink as ink jet ink are increasing. As problems of pigment ink, poor dot diffusion and poor abrasion resistance can be mentioned. "Poor dot diffusion" refers to a phenomenon of insufficient ink spread in a planar direction during the process where ink jet ink collides with and is absorbed by coated printing paper. As a result of poor dot diffusion, streaky areas, i.e., white lines where overlapping of inks is insufficient, appear on the printed image. It is therefore necessary to inhibit poor dot diffusion. "Poor abrasion resistance" refers to a phenomenon where ink comes off from a printed portion of a coated printing paper by being rubbed with something. Due to such poor abrasion resistance, smudges occur on printed image. It is therefore necessary to improve abrasion resistance property.

As coated printing paper for ink jet printing machines, there are following recording media: those in which the base paper absorbs ink 1.5 times as much as the coating layer does (see, for example, Patent Document 2); those having a specific degree of water content and stiffness in CD/MD direction (see, for example, Patent Document 3); those comprising a base paper, a binder layer and further a second layer containing kaolin and polyvinyl alcohol, and having a specific water absorption degree (see, for example, Patent Document 4). These papers, however, have no sufficient ink fixing property nor ink absorption property for ink jet printing.

As recording papers where the contact angle and droplet absorption time are specified, there are following papers exclusive use for ink jet printers: those having an absorbed amount of 0.15 μl or more and a contact angle of 50° or more of 2 μl of pure water, after 5 seconds from dropping thereof (see, for example, Patent Document 5); those having a contact angle of 40° to 80°, both inclusive, of water, after 0.04 second (see, for example, Patent Document 6); those having a contact angle of 10° to 30°, both inclusive, of an deionized water after 0.5 second (see, for example, Patent Document 7); those having an absorption time of 60 seconds or less of 5 μl of a liquid having a surface tension of 40 mN/m and a contact angle of 50° to 80°, both inclusive, of the liquid after 0.1 second (see, for example, Patent Document 8). These exclusive papers for ink jet printers where the contact angle and liquid absorption time are specified, however, are for printers which perform printing on a one sheet-by-one sheet basis, and thus they fail to have ink jet printability.

[Patent Document 1] Japanese Laid-open Patent [Kokai] Publication No. 2009-23292

[Patent Document 2] Japanese Laid-open Patent [Kokai] Publication No. 2007-118289

[Patent Document 3] Japanese Laid-open Patent [Kokai] Publication No. 2007-83681

[Patent Document 4] Japanese Laid-open Patent [Kokai] Publication No. 2009-125947

[Patent Document 5] Japanese Laid-open Patent [Kokai] Publication No. 2007-185780

[Patent Document 6] Japanese Laid-open Patent [Kokai] Publication No. 2005-88482

[Patent Document 7] Japanese Laid-open Patent [Kokai] Publication No. 2005-153221

[Patent Document 8] Japanese Laid-open Patent [Kokai] Publication No. 2002-347328

DISCLOSURE OF THE INVENTION

Problem to be Solved by the Invention

In ink jet printing machines, the printing time per A4-size paper, for example, is one second or less, and thus they perform overwhelming high-speed printing compared with wide-format ink jet printers and even compared with ink jet printers for home use. Therefore, coated printing paper is required to have a quality corresponding to ink jet printing machines. That is, from when ink impacts on a printing paper to when the printing paper is rolled up by a rotary press, or to when sheets of the printing paper overlap with one another in a paper receiving tray in the case of a sheet-fed press, retention of the strength of the coating layer, quick absorption of the ink, secure fixing of the ink, inhibition of poor dot diffusion of the ink impacted on the surface of the printing paper are required. Furthermore, since they are handled as commercial printed matter, printed portions of the printed matter are required to be excellent in abrasion resistance property, and also to have functions such as excellent ink adhesion property so that the ink fixed on the coated printing paper do not detach. There exists no such coated printing paper, in particular, no such papers with gloss.

When general-purpose coated printing papers are used for ink jet printing machines, however, they exhibit poor ink fixing and ink absorption properties, and thus it is not possible to produce fine printing. While exclusive papers for ink jet printers provided with an ink receiving layer are excellent in ink absorption property, since they have too good ink absorption property, ink droplets impacted on such papers do not spread sufficiently, which causes poor dot diffusion. As a result, white lines occur on printed portions. Thus, it is not possible to attain an ink fixing property, ink absorption property, inhibition of poor dot diffusion or abrasion resistance property of printed portions corresponding to ink jet printing machines, by general-purpose printing papers or exclusive papers for ink jet printers.

The purport of the present invention is to provide a coated printing paper to be used for ink jet printing machines, which has an ink fixing property and ink absorption property corresponding to ink jet printing, which inhibits poor dot diffusion, and which is excellent in abrasion resistance property of printed portions.

Means for Solving the Problem

The objects of the present invention can be achieved by a coated printing paper comprising a base paper, an undercoating layer which is applied on at least one surface of the base paper and contains a pigment and a binder, and one or more coating layers on the undercoating layer, wherein the base paper contains at least one selected from a cationic resin and a multivalent cation salt, and the uppermost coating layer contains at least a colloidal silica, and the 75° gloss according to JIS Z8741 of a surface of the uppermost coating layer is 40% or more.

In the present invention, the base paper may have a Cobb water absorption degree according to JIS P8140 of 60 g/m$^2$ or more at a contact time of 30 seconds, whereby an improved ink absorption property or inhibition of poor dot diffusion can be achieved.

In the present invention, the colloidal silica contained in the uppermost coating layer may include a colloidal silica composite synthetic resin, whereby an improved abrasion resistance property can be achieved.

In the present invention, the glass transition temperature of the synthetic resin included in the colloidal silica composite synthetic resin may be 50° C. or more, whereby an improved ink fixing property or abrasion resistance property of printed portions can be achieved.

In the present invention, the uppermost coating layer may contain a water dispersible binder and the glass transition temperature of the water dispersible binder may be lower than the glass transition temperature of the synthetic resin included in the colloidal silica composite synthetic resin, whereby an improved ink fixing property or abrasion resistance property of printed portions can be achieved.

Another preferred embodiment of the present invention is a coated printing paper comprising a base paper, an undercoating layer which is applied on at least one surface of the base paper and contains a pigment and a binder, and one or more coating layers on the undercoating layer, wherein the contact angle of a mixture solution of deionized water and glycerine (deionized water/glycerine=8/2) on a surface of the uppermost coating layer is 55° to 85°, both inclusive, after 0.1 second of contact with the mixture solution, and 25° to 45°, both inclusive, after 1.5 seconds of contact, and the 75° gloss according to JIS Z8741 of the surface of the coating layer is 40% or more, whereby the objects can be achieved.

In the coated printing paper having the aforementioned contact angles, when 1 μl droplet of a mixture solution of an deionized water and glycerine (deionized water/glycerine=8/2) is added dropwise to the surface of the uppermost coating layer, the volume fraction of the remaining droplet after 1.5 seconds from the dropping may be 75% to 100%, both inclusive, and the volume fraction of the remaining droplet after 10 seconds from the dropping may be 60% to 85%, both inclusive, whereby an improved ink fixing ink property and abrasion resistance property of printed portions can be achieved and poor dot diffusion can also be inhibited.

As yet another preferred embodiment of the present invention, provided is a printing method, using an ink jet printing machine, comprising the steps of obtaining the aforementioned coated printing paper, and performing ink jet printing using pigment ink on the coating layer of the coated printing paper at a printing speed of 15 m/min or more to form a printed image. Furthermore, the present invention provides a method for forming an excellent printed image, comprising the steps of obtaining the aforementioned coated printing paper and forming a printed image on the coating layer of the coated printing paper using an ink jet printing machine.

Effect of the Invention

According to the present invention, it is possible to obtain a coated printing paper having an ink fixing and ink absorption properties corresponding to ink jet printing. Also, it is possible to obtain a coated printing paper which can achieve an abrasion resistance property of printed portions, and in which poor dot diffusion can be inhibited and occurrence of white lines can be prevented even when printed by an ink jet printing machine employing pigment ink.

BEST MODE FOR CARRYING OUT THE INVENTION

The coated printing paper according to the present invention will be described in detail below.

As a base paper of the present invention, there can be mentioned papers made under acidic, neutral or alkaline condition from paper stock obtained from chemical pulp such as LBKP and NBKP, mechanical pulp such as GP, PGW, RMP, TMP, CTMP, CMP and CGP, and recycled paper pulp such as DIP to which are blended various fillers such as precipitated calcium carbonate, ground calcium carbonate, talc, clay and kaolin, as well as various additives such as sizing agents, fixing agents, retention aids, cationating agents such as cationic resins and multivalent cation salts and paper strengthening additives.

In the present invention, other additives may be added to the paper stock of the base paper within the scope not impairing the desired effect of the present invention, and such additives include: pigment dispersants, thickening agents, fluidity improving agents, defoamers, antifoamers, releasing agents, foaming agents, penetrating agents, coloring dyes, coloring pigments, optical brighteners, ultraviolet absorbing agents, antioxidants, preservatives, fungicides, insolubilizers, wet paper strengthening additives and dry paper strengthening additives.

To the base paper to be used in the present invention is added beforehand one or more selected from a cationic resin and a multivalent cation salt. By containing one or more selected from a cationic resin and a multivalent cation salt, the coated printing paper can possess an ink fixing and ink absorption properties suitable for ink jet printing. Although the reason therefor is not clear, it is considered that mild aggregation occurs in a coating colour for forming an undercoating layer in the vicinity of the interface between the base paper and the coating colour when an undercoating layer is formed on the base paper, resulting in a porous structure of the undercoating layer in the vicinity of the base paper.

The cationic resin refers to those commonly used such as cationic polymers and cationic oligomers which exhibit a cationic property as a result of dissociation when dissolved in water, and their types are not particularly limited. Polymers or oligomers containing a primary, secondary or tertiary amine or a quaternary ammonium salt which exhibits a cationic property as a result of dissociation when dissolved in water are preferable. Specific examples thereof include, for example, compounds such as polyethyleneimine, polyvinylpyridine, polyamine sulfone, polydialkylaminoethylmethacrylate, polydialkylaminoethylacrylate, polydialkylaminoethylmethacrylamide, polydialkylaminoethylacrylamide, polyepoxyamine, polyamideamine, dicyandiamide-formalin condensate, dicyandiamidepolyalkyl-polyalkylenepolyamine condensate, polyvinylamine and polyallylamine, and hydrochlorides thereof; further, polydiallyldimethyl ammonium chloride, copolymers of diallyldimethyl ammonium chloride and acrylamide; polydiallylmethylamine hydrochloride; dimethylamine-ammonia-epichlorohydrin condensate; and dimethylamine-epichlorohydrin condensate, but are not limited to those. In the present invention, while the mean molecular weight of the cationic resin is not particularly limited, it is preferably 500 to 20,000, both inclusive, and more preferably 1,000 to 10,000, both inclusive.

As used herein "multivalent cation salt" refers to a salt containing a water-soluble multivalent cation, preferably a salt containing a multivalent cation having a solubility of 1 mass % or more in water at 20° C. Examples of the multivalent cation include, for example, bivalent cations such as magnesium, calcium, strontium, barium, nickel, zinc, copper, iron, cobalt, tin, and manganese; trivalent cations such as aluminum, iron and chrome; or quaternary cations such as titanium and zirconium; and their complex ion thereof. As the anion which forms a salt with a multivalent cation, either inorganic acid or organic acid may be used, and it is not particularly limited. As the inorganic acid, there can be mentioned, without limitation, hydrochloric acid, nitric acid, phosphoric acid, sulfuric acid, boric acid and hydrofluoric acid. As the organic acid, there can be mentioned, without limitation, formic acid, acetic acid, lactic acid, citric acid, oxalic acid, succinic acid and organic sulfonic acid. As a preferable multivalent cation salt, magnesium chloride and calcium chloride can be mentioned.

The amount of the cationic resin or multivalent cation salt to be contained in the base paper is preferably in the range of 0.1 g/m$^2$ to 5 g/m$^2$, both inclusive, per surface in terms of dry solid content. Although there is no problem even if the amount exceeds this range, no further effect can be achieved, and thus it is not preferable in terms of cost.

As the method for causing a base paper to contain a cationic resin or a multivalent cation salt, there are a method of making paper after a cationic resin or a multivalent cation salt is contained in paper stock of the base paper, and a method of applying a cationic resin or a multivalent cation salt on the base paper or impregnating the base paper with a cationic resin or a multivalent cation salt. In view of the fact that the coating layer in the vicinity of the base paper forms a porous structure, the method of applying a cationic resin or a multivalent cation salt on the base paper or impregnating the base paper with a cationic resin or a multivalent cation salt is preferable. As the applying method, the methods of applying using various coating machines such as size presses, gate roll coaters and film transfer coaters, as well as blade coaters, rod coaters, air knife coaters and curtain coaters can be employed. In view of the manufacturing cost, preferred are on-machine coating using size presses, gate roll coaters and film transfer coaters mounted on paper making machines.

Conventional offset coated printing paper and exclusive paper for ink jet printer use a base paper having a high degree of sizing in order to suppress bleeding of ink. On the other hand, due to a low degree of sizing of the base paper in the present invention, a favorable ink absorption property is achieved and poor dot diffusion can be inhibited, and thus a low degree of sizing is preferable.

The degree of sizing of the base paper can be adjusted/controlled by the amount of the internal sizing agent added when a base paper is made, the amount of the surface sizing agent used during size press process, the amount of coating of the coating layer, etc. The degree of sizing of the base paper can be represented by a Cobb water absorption degree. The larger the Cobb water absorption degree is, the lower the degree of sizing is. The internal sizing agent, for example, is a rosin-based sizing agent for acidic paper, and for neutral paper, alkenyl succinic anhydride, alkylketene dimer, a neutral rosin-based sizing agent or a cationic styrene-acrylic sizing agent. The surface sizing agent, for example, is a styrene-acrylic sizing agent, an olefinic sizing agent and a styrene-maleic sizing agent. When, in particular, the surface sizing agent is applied together with the aforementioned cationic resin or multivalent cation salt, a cationic or nonionic surface sizing agent is preferable. The content of the sizing agent in the base paper as the internal sizing agent is preferably 0.01 to 1.0 mass %, and more preferably 0.03 to 0.8 mass % with respect to the pulp mass. The amount of the surface sizing agent to be applied on the base paper is preferably 0.01 g/m$^2$ to 1.0 g/m$^2$, both inclusive, and more preferably 0.02 g/m$^2$ to 0.5 g/m$^2$, both inclusive.

The Cobb water absorption degree according to JIS P8140 of the base paper at a contact time of 30 seconds of the base paper with water, is preferably 60 g/m$^2$ or more in the present invention. More preferably, the Cobb water absorption degree is 100 g/m$^2$ or more. By defining this range, an improved ink absorption property and inhibition of poor dot diffusion can be achieved.

While the thickness of the base paper of the present invention is not particularly limited, it is 50 to 300 μm, both inclusive, and preferably 80 to 250 μm, both inclusive.

According to the present invention, due to the constitution that the coating layer comprises a base paper containing one or more selected from a cationic resin and a multivalent cation salt, an undercoating layer provided on the base paper, and the uppermost coating layer containing at least a colloidal silica, a coated printing paper having an ink absorption property, an ink fixing property, an abrasion resistance property of printed portions and inhibition of poor dot diffusion corresponding to ink jet printing machines can be obtained. As used herein "the uppermost coating layer" refers to the outermost coating layer from the base paper.

Although the reason therefore is not clear, the following reasons are considered. That is, as a result of the base paper containing a cationic resin or a multivalent cation salt, the undercoating layer on the base paper forms a porous structure, whereas the uppermost coating layer forms uniform and fine voids by containing a colloidal silica. Due to the combined effect of these, it is considered that the coated printing paper has an ink absorption property and an ink fixing property and further can inhibit poor dot diffusion, and the abrasion resistance property of the printed portions corresponding to ink jet printing machines can be obtained.

In order to obtain an ink absorption property and an ink fixing property or inhibition of poor dot diffusion corresponding to ink jet printing machines, the Cobb water absorption degree according to JIS P8140 of a coating layer, after an undercoating layer and a coating layer are provided on a base paper, at a contact time with water of 30 seconds, is preferably 60 $g/m^2$ or more in the present invention.

The colloidal silica used in the uppermost coating layer of the present invention, is a micro particle silica sol dispersed in water in a colloidal state, and generally known colloidal silica can be used. A preferable mean particle size of the colloidal silica is in the range of 5 nm to 80 nm, both inclusive, more preferably 10 nm to 50 nm, both inclusive. If the mean particle size of the colloidal silica is less than 5 nm, the ink absorption property can be reduced, and when it exceeds 80 nm, inhibition of poor dot diffusion can be insufficient.

As used herein "mean particle size" refers to a mean particle size based on a particle size distribution measurement based on volume using laser diffraction/scattering or dynamic light scattering method. When the mean particle size is 3 μm or more, it is a mean particle size based on Coulter counter measurement. The measurement can, for example, be made by a laser diffraction/scattering particle size distribution measuring apparatus, Microtrac MT3000II, manufactured by Nikkiso Co., Ltd.

The uppermost coating layer of the present invention may contain a colloidal a silica composite synthetic resin as a colloidal silica. As a result of the uppermost coating layer containing a colloidal silica composite synthetic resin, the abrasion resistance property of printed portions can further be enhanced when printed by ink jet printing machine employing pigment ink.

The colloidal silica composite synthetic resin contained in the coating layer in the present invention, is disclosed in Japanese Laid-open Patent [Kokai] Publication No. Sho 59-71316 (1984), Japanese Laid-open Patent [Kokai] Publication No. Sho 59-152972 (1984), Japanese Laid-open Patent [Kokai] Publication No. Sho 60-127371 (1985), and Japanese Patent No. 3599677.

The colloidal silica composite synthetic resin has the structure that colloidal silica of a mean particle size of 5 nm to 80 nm, both inclusive, binds to the surface of synthetic resin particles of a mean particle size of 10 nm to 100 nm, both inclusive. It is differentiated from the state that colloidal silica and synthetic resin particles are contained independently and separately from each other in that colloidal silica and synthetic resin particles are chemically bound with each other.

In the colloidal silica composite synthetic resin, the synthetic resin can be obtained by emulsion polymerization of a radical polymerizable unsaturated monomer having a silyl group and a copolymerizable radical polymerizable unsaturated monomer having no silyl group in the presence of a surfactant.

The emulsion polymerization is carried out in an aqueous medium with the addition of a polymerization initiator. At this time, as the other components, a protective colloid, a chain transfer agent, a pH adjustor, an ultraviolet absorbing agent, an anti-photo oxidant, or the like can be used as necessary.

For the emulsion polymerization, publicly known emulsion polymerization methods can be used. Various polymerization methods including, for example, a batch polymerization method in which respective components are placed all together into a reaction can for polymerization; a dropping polymerization method comprising prepolymerizing a part of a monomer in an aqueous medium containing an emulsifier, and then dropping and polymerizing the remaining emulsifier and monomer; an emulsified monomer dropping method in which components to be dropped are emulsified/dispersed in water in advance. As the emulsion polymerization method for obtaining a synthetic resin to be used in the colloidal silica composite synthetic resin of the present invention, it is preferable to use an emulsified monomer dropping method so as to obtain a synthetic resin of fine particles. Furthermore, the following methods can be used in combination as necessary: a multistage polymerization method in which monomer composition in polymerization stage is changed stage by stage; a power feed polymerization method in which monomer composition is gradually changed; a seed polymerization method in which polymerization is carried out by adding a seed as a core, and so forth.

As the radical polymerizable unsaturated monomer having a silyl group in the present invention, there can be mentioned, for example, vinyltrimethoxysilane, vinyltriethoxysilane, vinylmethyldimethoxysilane, vinyldimethylmethoxysilane, vinyltriacetoxysilane, vinyltrichlorosilane, vinyltris(2-methoxyethoxy) silane, 3-(meth)acryloxypropyltrimethoxysilane, 3-(meth)acryloxypropyltriethoxysilane, and 3-(meth) acryloxypropylmethyldimethoxysilane. These unsaturated monomers may be used alone, or two or more can be used in combination. As a preferable radical polymerizable unsaturated monomer having a silyl group, vinyltriethoxysilane, 3-(meth)acryloxypropyltrimethoxysilane, and 3-(meth)acryloxypropyltriethoxysilane can be mentioned in the light of polymerizability.

The amount of the radical polymerizable unsaturated monomer having a silyl group used in the polymerization reaction, based on 100 parts by mass of all radical polymerizable unsaturated monomers used (including the later-described radical polymerizable surfactant), is preferably 0.1 part by mass to 15 parts by mass, both inclusive, and more preferably 0.5 part by mass to 10 parts by mass, both inclusive. When the amount of radical polymerizable unsaturated monomer having a silyl group used is less than 0.1 part by mass, the degree of composite action between a synthetic resin and a colloidal silica can be insufficient. When it exceeds 15 parts by mass, unstable polymerization, a large amount of agglomerates, a higher viscosity of the reaction solution etc. occur, which can result in failure of favorable polymerization. By using a radical polymerizable unsaturated monomer having a silyl group as a monomer of a synthetic resin, it is possible to couple a silanol group of colloidal silica with the synthetic resin, so that colloidal silica and the synthetic resin are chemically bound with each other to form a colloidal silica composite synthetic resin.

The copolymerizable radical polymerizable unsaturated monomer having no silyl group in the present invention is preferably obtained, for example, by combining one or more selected from the group consisting of alkyl ester of (meta) acryl acid, the alkyl group of which is those having a carbon number of 1 to 12 such as methyl, ethyl, n-butyl, t-butyl, propyl, 2-ethylhexyl and octyl; cycloalkyl ester of (meta) acryl acid such as cyclohexylacrylate and cyclohexylmethacrylate; and styrene, or vinyl ester of branched carboxylic acid, with one or more selected from the group of ethylenically unsaturated carboxylic acids consisting of acryl acid, methacrylic acid, crotonic acid and maleic acid. More preferred is a combination use of one or more selected from the group consisting of ethyl acrylate, butyl acrylate, methyl methacrylate, styrene and 2-ethylhexyl acrylate, with (meta) acryl acid.

Furthermore, the glass transition temperature (hereinafter also referred to as "Tg") of the synthetic resin included in the colloidal silica composite synthetic resin is preferably 50° C. or more and more preferably 70° C. or more. Tg being 50° C. or more, an ink fixing property and an abrasion resistance property of printed portions corresponding to ink jet printing machines can be achieved.

Tg can be obtained in the present invention by measurement using a differential scanning calorimetry (DSC), for example, EXSTAR 6000 (manufactured by Seiko Instruments Inc.), DSC220C (manufactured by Seiko Instruments Inc.) and DSC-7 (manufactured by PerkinElmer Co., Ltd.). In the measurement using DSC, the glass transition phenomenon is observed as a shift of the base line to an endothermic direction, and the point of intersection between the baseline and the slope of endothermic peak is defined as Tg.

Furthermore, the glass transition temperature of the synthetic resin included in the colloidal silica composite synthetic resin can be adjusted in the present invention by preparing a synthetic resin by combining a monomer forming a polymer having a relatively low Tg with a monomer forming a polymer having a relatively high Tg. As the monomer forming a polymer having a relatively low Tg, there can be mentioned, for example, ethyl acrylate, butyl acrylate and 2-ethylhexyl acrylate. As the monomer forming a polymer having a relatively high Tg, there can be mentioned, for example, acryl acid, methacrylic acid, methyl methacrylate, styrene, cyclohexyl acrylate and cyclohexyl methacrylate.

The surfactant used in emulsion polymerization functions as an emulsifier in emulsion polymerization in the present invention. As the surfactant used in emulsion polymerization, common anionic, cationic or nonionic surfactants can be used. Furthermore, a radical polymerizable surfactant having one or more radical polymerizable unsaturated groups in the molecules can preferably be used. A radical polymerizable surfactant can be copolymerized with a monomer at the time of emulsion polymerization due to the presence of a polymerizable unsaturated bond in the molecules. Because of this, the surfactant does not remain as a surfactant as it is after emulsion polymerization. Therefore, when a coating layer is formed, the surfactant does not bleed out on the coating surface as a free surfactant, nor does it impair the ink absorption property, and thus such surfactant is preferable. Such radical polymerizable surfactant can suitably be selected from publicly known substances.

The synthetic resin included in the colloidal silica composite synthetic resin is in the form of a particle, and the mean particle size of the synthetic resin particle is preferably 10 nm to 100 nm, both inclusive. When the mean particle size of the synthetic resin particle is less than 10 nm, the particle size of the resultant colloidal silica composite synthetic resin is small, leading to reduction in porosity of the surface, which can lower ink absorption property. On the other hand, when the mean particle size exceeds 100 nm, the particle size of the resultant colloidal silica composite synthetic resin is too large and the porosity of the surface is too high, which can lead to poor dot diffusion. The mean particle size of the synthetic resin particle is more preferably 20 nm to 80 nm, both inclusive.

The colloidal silica composite synthetic resin in the present invention can be obtained by mixing the thus obtained synthetic resin in the presence of colloidal silica, and heating as necessary so as to react the silyl group of the synthetic resin with the silanol group of the colloidal silica.

The colloidal silica included in the colloidal silica composite synthetic resin in the present invention can be a finely divided silica sol dispersed in water in a colloidal state like the above-described colloidal silica, and generally known colloidal silica can be used. The mean particle size of the colloidal silica when included in the colloidal silica composite synthetic resin is preferably 5 nm to 80 nm, both inclusive. By limiting the mean particle size of the colloidal silica to this range, colloidal silica can bind to a synthetic resin such that the colloidal silica covers around the entire synthetic resin. More preferably, the mean particle size of the colloidal silica is 10 nm to 50 nm, both inclusive. The mean particle size of the colloidal silica composite synthetic resin is preferably 20 nm to 300 nm, both inclusive, and more preferably, 50 nm to 200 nm, both inclusive.

As the colloidal silica, commercially available products can be used in the present invention for both as colloidal silica to be used alone and as colloidal silica to be included in the colloidal silica composite synthetic resin. Also, colloidal silica which is surface-treated with a metal ion such as a meta-aluminate ion can be used. The shape of the colloidal silica may be colloidal silica in the form of a single particle, or colloidal silica connected in the form of a string of beads or a branch as a result of special treatment. Colloidal silica which is surface-treated with a metal ion such as meta-aluminate ion is preferable in that it is excellent in mixing stability and in that it hardly aggregate.

The colloidal silica composite synthetic resin in the present invention preferably has a mass ratio of colloidal silica to synthetic resin in the range of colloidal silica/synthetic resin=30/70 to 70/30, both inclusive. When the mass ratio of colloidal silica/synthetic resin is less than 30/70, a sufficient ink fixing property or abrasion resistance property of printed portions corresponding to ink jet printing machines cannot be obtained, or, when it exceeds 70/30, the coating strength cannot be sufficient.

The uppermost coating layer of the present invention can include other pigments in addition to colloidal silica or colloidal silica composite synthetic resin.

As the other pigments, conventionally known pigments can be used. There can be mentioned, for example, inorganic pigments such as precipitated calcium carbonate, ground calcium carbonate, kaolin, talc, calcium sulfate, barium sulfate, titanium dioxide, zinc oxide, zinc sulfide, zinc carbonate, satin white, aluminum silicate, diatomite, calcium silicate, magnesium silicate, synthesized amorphous silica, alumina, colloidal alumina, pseudo boehmite, aluminium hydroxide, lithophone, zeolite, hydrated halloysite, magnesium carbonate and magnesium hydrate; and organic pigments such as styrene-based plastic pigments, acryl-based plastic pigments, polyethylenes, microcapsules, urea resins and melamine resins.

The content of the colloidal silica contained in the uppermost coating layer in the present invention is preferably 40 mass % or more, and more preferably 45 mass % or more with respect to the total pigments contained in the uppermost coating layer.

The uppermost coating layer in the present invention can contain various publicly known binders. As the binder to be contained, a water-based binder using water as a medium is preferable.

A "water-based binder" refers to a water-soluble binder or a water dispersible binder. As the water-soluble binder, there can be mentioned, for example, starch derivatives such as oxidized starch, etherified starch, and phosphate ester starch; cellulose derivatives such as methylcellulose, carboxy methylcellulose and hydroxy ethylcellulose; polyvinyl alcohol derivatives such as polyvinyl alcohol or silanol modified polyvinyl alcohol; natural polymer resins such as casein, gelatin or their modified products, soybean protein, pullulan, gum arabic, karaya gum and albumin, or derivatives thereof; vinyl polymers such as polyacrylamide and polyvinylpyrrolidone; and alginate, polyethyleneimine, polypropylene glycol, polyethylene glycol, maleic anhydride or copolymers thereof, but not limited to those. As the water dispersible binder, there can be mentioned, for example, latex-based binders including conjugated diene-based copolymer latexes such as styrene-butadiene copolymer and methylmethacrylate-butadiene copolymer; acrylic copolymer latexes such as polymers of acrylic acid ester or methacrylic acid ester or copolymers thereof; vinyl-based copolymer latexes such as ethylene-vinyl acetate copolymer, and vinyl chloride-vinyl acetate copolymer; polyurethane resin latex, alkyd resin latex, unsaturated polyester resin latex, or functional group-modified copolymer latexes of these various copolymers modified by monomers containing a functional group such as carboxyl group; and thermosetting synthetic resins such as melamine resin and urea resin, but are not limited to those. These water-based binders can be used alone or as a mixture of two or more. Water dispersible binders are preferable because absorption property and ink fixing property corresponding to ink jet printing machines can be attained, and among them, styrene-butadiene copolymer or methylmethacrylate-butadiene copolymer is preferable.

Furthermore, the Tg of the water dispersible binder is preferably lower than the Tg of synthetic resin included in the colloidal silica composite synthetic resin. By setting the Tg of the water dispersible binder lower than that of synthetic resin, more excellent ink fixing property and abrasion resistance property of printed portions corresponding to ink jet printing machines can be achieved. A more preferable water dispersible binder is a styrene-butadiene copolymer or a methylmethacrylate-butadiene copolymer having a Tg lower than the Tg of the synthetic resin included in the colloidal silica composite synthetic resin. The Tg of the binder can be adjusted by changing the monomers to be selected or the blend ratio of the monomers to be copolymerized.

The content of total binders in the uppermost coating layer is 60 mass % or less, preferably 30 mass % or less, and more preferably 15 mass % or less with respect to the total solid content in the uppermost coating layer in the light of the ink absorption property and inhibition of poor dot diffusion corresponding to ink jet printing machines.

In one embodiment of the present invention, when the 75° gloss according to JIS Z8741 of the surface of the uppermost coating layer is 40% or more, the contact angle of a mixture solution (deionized water/glycerine=8/2) on the surface of the uppermost coating layer is preferably 55° to 85°, both inclusive, after 0.1 second of contact with the mixture solution, and 25° to 45°, both inclusive, after 1.5 seconds of contact.

By limiting the contact angle to this range, the coating layer can attain an excellent ink fixing property, ink absorption property, abrasion resistance property of printed portion, or inhibition of poor dot diffusion when an ink jet printing machine is used. If the contact angle is out of the aforementioned range, the effect of the present invention cannot be achieved in some aspects of these ink jet printabilities.

In the present invention, the mixture solution of deionized water and glycerine used in the measurement of the contact angle has a mixture ratio by mass of deionized water/glycerine=8/2. Furthermore, the surface tension of the mixture solution of deionized water and glycerine is adjusted to the range of 20 mN/m to 30 mN/m, both inclusive, by adding an anionic fluorochemical surfactant. The ink jet ink is an aqueous solution containing a coloring material in water as a medium, and generally contains an anti-drying agent such as glycerine. Therefore, the mixture solution of deionized water and glycerine (deionized water/glycerine=8/2) used in the present invention is a solution similar to the ink jet ink used in ink jet printing machine.

In the present invention, a contact angle is determined by dropping 1 μl of droplet of the mixture solution (deionized water/glycerine=8/2) on a coating layer, and analyzing the image-data taken at a predetermined contact time period using a commercial contact angle measuring instrument. Image data analysis is performed by a curve fitting method in which computation is made assuming the shape of the droplet as a true sphere or a portion of an ellipsoid. An example of such contact angle measuring instrument, for example, is an automatic contact angle meter, CA-VP300 (manufactured by Kyowa Interface Science Co., Ltd.). In the present invention, 1 μl of droplet may be in the range of 1μ±20%, and as long as the droplet is in this range, there is no problem in the measurement.

"Remaining droplet volume fraction" as used herein refers to the percentage of the volume of droplet remaining on the surface of a coating layer, within a certain time range after dropping of a predetermined droplet on the coating layer, with respect to the volume of the droplet dropped, as shown in the following equation (1).

$$\text{Remaining droplet volume fraction}(\%)=\{(\text{Volume } V_t \text{ of droplet remaining on the surface of a coating layer after } t \text{ second(s)from dropping})/(\text{Volume of dropped droplet})\}\times 100 \quad \text{Equation (1):}$$

In the present invention, the remaining droplet volume fraction is the percentage of a value obtained by dividing the volume of droplet remaining on a coating layer not having been absorbed after a predetermined time from dropping of 1 μl of droplet of the aforementioned mixture solution (deionized water/glycerine=8/2) on the coating layer, by the volume of the dropped droplet. Here, the volume of the remaining droplet can be computed by applying to the following equation (2) the droplet radius and the droplet height measured from the image analysis data obtained by a commercial contact angle measuring instrument. In the present invention, 1 μl of droplet may be in the range of 1μ+20%, and as long as the droplet is in this range, there is no problem in the measurement.

$$V_t=\pi\times(r_t\times r_t\times h_t/2+h_t\times h_t\times h_t/6) \quad \text{Equation (2)}$$

$V_t$: volume of the droplet (μl) remaining on the surface of the coating layer, after t second(s) from dropping π: pi (circumference ratio)

$r_t$: the radius of the droplet to be measured (μm) on the surface of the coating layer after t second(s) from dropping $h_t$: the height of the droplet to be measured (μm) on the surface of the coating layer after t second(s) from dropping Examples of such contact angle measuring instrument include, for example, an automatic contact angle meter CA-VP300 (manufactured by Kyowa Interface Science Co., Ltd.).

In the coated printing paper of the present invention, the uppermost coating layer preferably has a remaining droplet volume fraction, with respect to 1 μl of droplet of the mixture solution (deionized water/glycerine=8/2), of 75% to 100%, both inclusive, after 1.5 seconds from the dropping of the droplet on the surface of the coating layer, and 60% to 85%, both inclusive, after 10 seconds from the dropping. By limiting the remaining droplet volume fraction to this range, a more excellent ink fixing property, abrasion resistance property of the printed portions, and inhibition of poor dot diffusion can be attained when an ink jet printing machine is used. If the remaining droplet volume fraction is out of the range of the present invention, the effect of the present invention may not be achieved in some aspects of these ink jet printabilities.

In the present invention, adjustment of the contact angle of the uppermost coating layer or the remaining droplet volume fraction to the aforementioned respective ranges can be achieved by a technique of combining various conditions such as the amount of coating, pigment type, mean particle size of pigment, particle size distribution of pigment, shape of pigment, oil absorbency of pigment, type of resin as a binder, molecular weight or degree of polymerization, mixing a water dispersible binder with a water-soluble binder, or ratio of the mixture, and ratio of pigment to binder.

As a method to adjust the contact angle of the uppermost coating layer or the remaining droplet volume fraction to the aforementioned respective ranges, more specifically, there are following methods: (1) combining a platy or spherical pigment with an amorphous pigment, (2) causing the layer to contain a colloidal silica having a mean particle size of 100 nm or less, (3) causing a platy or spherical pigment to be contained in a high ratio, (4) causing the colloidal silica composite synthetic resin to be contained, (5) causing the binder to be contained in 5 parts by mass to 35 parts by mass with respect to 100 parts by mass of pigments, and (6) causing a water dispersible binder to be contained in a high ratio with respect to total binders in the coating layer, and (7) performing a mild calendering process. The contact angle or remaining droplet volume fraction in the aforementioned respective ranges can be achieved by using these respective methods alone or in combination, but the methods are not limited to those.

The amount of the uppermost coating layer to be applied is 3 $g/m^2$ to 12 $g/m^2$, both inclusive, and more preferably 4 $g/m^2$ to 10 $g/m^2$, both inclusive, in terms of dry solid content. By limiting the amount to be applied to this range, more excellent ink absorption property, ink fixing property and inhibition of poor dot diffusion corresponding to ink jet printing machines can be attained.

The uppermost coating layer can contain a cationic resin or a multivalent cation salt as necessary in order to further enhance the ink fixing property, ink absorption property or inhibition of poor dot diffusion.

The cationic resin that can be contained in the uppermost coating layer is, like the cationic resin to be used in the base paper, a commonly used cationic polymer or cationic oligomer which exhibits a cationic property as a result of dissociation when dissolved in water, and the type is not particularly limited. The multivalent cation salt that can be contained in the uppermost coating layer is, like the multivalent cation salt to be used in the base paper, a water-soluble multivalent cation salt or a salt containing a multivalent cation having a solubility of 1 mass % or more in water at 20° C. The type is not particularly limited.

In the uppermost coating layer, as additives, an ink fixing agent, a pigment dispersant, a thickening agent, a fluidity improving agent, a surfactant, a defoamer, an antifoamer, a releasing agent, a foaming agent, a penetrating agent, a coloring dye, a coloring pigment, an optical brightener, an ultraviolet absorbing agent, an antioxidant, a preservative, a fungicide, an insolubilizer, a printability improving agent, a wet paper strengthening additive and a dry paper strengthening additive can suitably be blended in addition to colloidal silica and a water-based binder.

As the method of applying the uppermost coating layer, commonly used coating methods can be used, and there is no particular limitation. As coating machines to be used for such coating methods, there can be mentioned, for example, air knife coaters, blade coaters, roll coaters, bar coaters, rod blade coaters, curtain coaters and short dwell coaters. Preferred are blade coaters, air knife coaters and curtain coaters.

In the present invention, the 75° gloss according to JIS Z8741 of the surface of the coating layer is 40% or more, and preferably in the range of 60% to 90%, both inclusive. As long as it is in this range, a gloss close to that of general-purpose CWF gloss coated paper can be attained. The gloss can be adjusted by the content or the applied amount of colloidal silica in the uppermost coating layer, or by the addition of other pigments than colloidal silica, for example, colloidal alumina. Furthermore, by performing a calendering process, a higher gloss can be imparted. As the calendering process apparatus, machine calenders, super calenders and soft nip calenders can be mentioned. In addition, a gloss can be applied using a publicly known cast coating method.

In the coated printing paper of the present invention, one or more intermediate coating layers containing a pigment and a binder may be disposed between the uppermost coating layer and the undercoating layer in order to achieve the purpose of adjusting the surface quality and glossiness.

As the pigment used in the intermediate coating layer, one or more conventionally known pigments can be used. Such pigments include, for example, salts of alkaline earth metal such as calcium carbonate, calcium sulfate, calcium silicate, magnesium carbonate, magnesium silicate and barium sulfate; inorganic pigments such as kaolin, talc, titanium dioxide, zinc oxide, zinc sulfide, zinc carbonate, satin white, aluminum silicate, diatomite, synthesized amorphous silica, colloidal silica, alumina, colloidal alumina, pseudo boehmite, aluminium hydroxide, lithophone, zeolite and hydrated halloysite; and organic pigments such as styrene-based plastic pigments, acryl-based plastic pigments, polyethylene, microcapsules, urea resins and melamine resins. Among these, calcium carbonate, kaolin, synthesized amorphous silica are preferable in the light of ink absorption property and glossiness.

As the binder to be used for the intermediate coating layer, publicly known various water-based binders can be used. The water-based binder is a water-soluble binder or a water dispersible binder. As the water-soluble binder, there can be mentioned, for example, starch derivatives such as oxidized starch, etherified starch and phosphate ester starch; cellulose derivatives such as methylcellulose, carboxy methylcellulose and hydroxy ethylcellulose; polyvinyl alcohol derivatives such as polyvinyl alcohol or silanol modified polyvinyl alcohol; natural polymer resins such as casein, gelatin or their modified products, soybean protein, pullulan, gum arabic, karaya gum and albumin, or derivatives thereof; vinyl polymers such as polyacrylamide and polyvinylpyrrolidone; and alginate, polyethyleneimine, polypropylene glycol, polyethylene glycol, maleic anhydride or copolymers thereof, but not limited to those. As the water dispersible binder, there can be mentioned, for example, latex-based binders including conjugated diene-based copolymer latexes such as styrene-butadiene copolymer and methylmethacrylate-butadiene copolymer; acrylic copolymer latexes such as polymers of acrylic acid ester or methacrylic acid ester or copolymers thereof; vinyl-based copolymer latexes such as ethylene-vinyl acetate copolymer and vinyl chloride-vinyl acetate copolymer; polyurethane resin latex, alkyd resin latex, unsaturated polyester resin latex, or functional group-modified copolymer latexes of these various copolymers modified by monomers containing a functional group such as carboxyl group; and thermosetting synthetic resins such as melamine resin and urea resin, but are not limited to those. These water-based binders can be used alone or as a mixture of two or more.

The amount of the binder to be blended in the intermediate coating layer is preferably 5 mass % to 25 mass %, both inclusive, with respect to the pigment contained in the intermediate coating layer in the light of the ink absorption property and inhibition of poor dot diffusion corresponding to ink jet printing machines. More preferably, it is 7 mass % to 20 mass %, both inclusive.

In the intermediate coating layer, as additives, an ink fixing agent, a pigment dispersant, a thickening agent, a fluidity improving agent, a printability improving agent, a surfactant, a defoamer, an antifoamer, a releasing agent, a foaming agent, a penetrating agent, a coloring dye, a coloring pigment, an optical brightener, an ultraviolet absorbing agent, an antioxidant, a preservative, a fungicide, an insolubilizer, a wet paper strengthening additive, a dry paper strengthening additive, and the like can suitably be blended in addition to the pigment and the binder.

As the method for applying an intermediate coating layer, commonly used coating methods can be used, and the method is not particularly limited. For example, air knife coaters, blade coaters, roll coaters, bar coaters, rod blade coaters, curtain coaters, short dwell coaters and the like can be mentioned. Preferred are blade coaters, air knife coaters, and curtain coaters.

The amount of the intermediate coating layer to be applied is preferably in the range of 3 $g/m^2$ to 20 $g/m^2$, both inclusive, in terms of dry solid content.

In the present invention, an undercoating layer containing a pigment and a binder is provided on the surface(s) as "at least one surface" of the base paper, to which a coating layer is to be applied.

In the present invention, the pigment used in the undercoating layer is preferably a pigment having no porosity. The presence or absence of porosity can be expressed by a BET specific surface area. Pigments having no porosity have a specific surface area value of 100 $m^2/g$ or less according to the BET method. With a pigment having no porosity, the ink absorption property and inhibition of poor dot diffusion corresponding to ink jet printing machine can further be made favorable. With a porous pigment, the ink absorption property can be excessive, leading to occurrence of white lines.

As a pigment having no porosity, there can be mentioned, for example, magnesium carbonate, ground calcium carbonate, precipitated calcium carbonate, zinc carbonate, satin white, kaolin, calcined kaolin, talc, clay, zinc oxide, titanium dioxide, calcium sulfate and barium sulfate.

The pigment to be used in the undercoating layer is preferably ground calcium carbonate, precipitated calcium carbonate and kaolin among the pigments having no porosity, in the light of the ink absorption property and inhibition of poor dot diffusion corresponding to ink jet printing machines.

In the embodiments of the present invention, the mean particle size of the pigment used in the undercoating layer is preferably selected from the range of 0.1 μm to 5 μm, both inclusive. More preferably, the pigments include two or more types of pigments different from each other in terms of mean particle size, wherein the mean particle size of smaller pigment with respect to the mean particle size of larger pigment sequentially satisfies the following Equation (3). Here the "two or more types" includes the same kinds of pigments having different mean particle sizes from each other.

$$R(a)=0.4\cdot R(A)\ to\ 0.7\cdot R(A) \qquad \text{Equation (3)}$$

R(A): mean particle size of larger pigment

R(a): mean particle size of smaller pigment

With pigments having a larger mean particle size than the aforementioned range, poor dot diffusion can be inhibited, but ink fixing and ink absorption properties may be poor and gloss may not be obtained. On the other hand, with pigments having a smaller mean particle size than the aforementioned range, ink fixing and ink absorption properties are favorable and gloss can easily be expressed, but inhibition of dot diffusion can be poor or the strength of the coating layer may not be attained. When the pigments include two or more types of pigments having different mean particle sizes from each other, and, at the same time, the two or more types of pigments satisfy the Equation (3) above, excellent ink fixing and ink absorption properties as well as inhibition of poor dot diffusion can be achieved.

For example, when pigments include three types of pigments differing in mean particle size, a first pigment having the largest mean particle size and a second pigment having the second largest mean particle size satisfy the Equation (3) above, and the second pigment having the second largest mean particle size and a third pigment having the third largest mean particle size satisfy the Equation (3) above. The relationship is repeated thereafter. It is preferred that the Equation (3) above be satisfied between inorganic pigment particles.

As a pigment having the largest mean particle size satisfying the Equation (3) above, kaolin is preferable. By using kaolin, more favorable ink absorption can be achieved.

Pigments having a mean particle size in the range of 0.1 μm to 5 μm, both inclusive, can be purchased as commercial products from Shiraishi Calcium Kaisha, Ltd., Hyo go Clay K.K., Fimatec Ltd., Okutama Kogyo Co., Ltd., Engelhard Corporation, Huber & Co. Ltd., IMERYS Pigments for Paper & Packaging, Tokuyama Corporation, Mizusawa Industrial Chemicals, Ltd., Tosoh Silica Corporation, W. R. Grace Co., —Conn., Shionogi & Co., Ltd, etc. It is also possible to obtain a desired mean particle size as needed from a pigment having a relatively large mean particle size by a method for microperticulation using a strong force of a mechanical means. As such mechanical means, there can be mentioned ultrasound homogenizers, pressure type homogenizers, liquid flow-impingement homogenizers, high-speed rotation mills, roller mills, container driving medium mills, wet medium stirring mills, jet mills, mortars, Raikai Machine or automated mortar (a device for grinding and kneading a subject to be ground in a bowl-like container with a pestle-like stirring rod), and sand grinders. Classification and circuit grinding can be carried out to make particle size smaller.

The content of a first pigment having the largest mean particle size in an undercoating layer satisfying the Equation (3) above, is less than 50 parts by mass, preferably 5 parts by mass to 45 parts by mass, both inclusive, based on 100 parts by mass of total pigments in the undercoating layer. By specifying the first pigment having the largest mean particle size to the range above, it is possible to achieve more favorable ink fixing and ink absorption properties and inhibition of poor dot diffusion.

As the binder used in the undercoating layer, publicly known various water-based binders using water as a medium can be used.

The water-based binders are water-soluble binders or water dispersible binders. As the water-soluble binder, there can be mentioned, for example, starch derivatives such as oxidized starch, etherified starch and phosphate ester starch; cellulose derivatives such as methylcellulose, carboxy methylcellulose and hydroxy ethylcellulose; polyvinyl alcohol derivatives such as polyvinyl alcohol or silanol modified polyvinyl alcohol; natural polymer resins such as casein, gelatin or their modified products, soybean protein, pullulan, gum arabic, karaya gum and albumin, or derivatives thereof; vinyl polymers such as polyacrylamide and polyvinylpyrrolidone; and alginate, polyethyleneimine, polypropylene glycol, polyethylene glycol, maleic anhydride or copolymers thereof, but not limited to those. As the water dispersible binder, there can be mentioned, for example, latex-based binders including conjugated diene-based copolymer latexes such as styrene-butadiene copolymer and methylmethacrylate-butadiene copolymer; acrylic copolymer latexes such as polymers of acrylic acid ester or methacrylic acid ester or copolymers thereof; vinyl-based copolymer latexes such as ethylene-vinyl acetate copolymer, and vinyl chloride-vinyl acetate copolymer, polyurethane resin latex, alkyd resin latex, unsaturated polyester resin latex, or functional group-modified copolymer latexes of these various copolymers modified by monomers containing a functional group such as carboxyl group; and thermosetting synthetic resins such as melamine resin and urea resin, but are not limited to those. These water-based binders can be used alone or as a mixture of two or more.

In the present invention, it is preferred that the binder of the undercoating layer contains one or more each from water-soluble binders and water dispersible binders, in the light of the ink absorption property and ink fixing property corresponding to ink jet printing machines. It is more preferred that the water-soluble binder be a starch derivative or polyvinyl alcohol derivative, and that the water dispersible binder be a styrene-butadiene copolymer or methylmethacrylate-butadiene copolymer.

The content ratio of the water-soluble binder to the water dispersible binder is preferably in the ratio of water-soluble binder/water dispersible binder (mass ratio)=1/10 to 6/10, both inclusive, in the light of the ink absorption property corresponding to ink jet printing machines.

The content of the binder in the undercoating layer is preferably 20 mass % or less and more preferably 15 mass % or less with respect to the total solid content of the undercoating layer in the light of the ink absorption property and coating strength of the undercoating layer corresponding to ink jet printing machines.

In the undercoating layer, additives can suitably be blended in addition to the pigment and the binder, and such additives include ink fixing agents, pigment dispersants, thickening agents, fluidity improving agents, printability improving agents, surfactants, defoamers, antifoamers, releasing agents, foaming agents, penetrating agents, coloring dyes, coloring pigments, optical brighteners, ultraviolet absorbing agents, antioxidant, preservatives, fungicides, insolubilizers, wet paper strengthening additives and dry paper strengthening additives.

The amount of the undercoating layer to be applied is preferably in the range of 2 g/m$^2$ to 7 g/m$^2$, both inclusive, and more preferably in the range of 3 g/m$^2$ to 6 g/m$^2$, both inclusive, in terms of dry solid content.

As the method for applying an undercoating layer, a commonly used coating method can be used, and the method is not particularly limited. For example, air knife coater, blade coater, roll coater, bar coater, rod blade coater, curtain coater and short dwell coater can be mentioned. Preferred are blade coater, air knife coater, and curtain coater.

The coated printing paper provided with an undercoating layer or respective coating layers can be used as it is. It is also possible to perform a calendering process after respective coating layers are provided in order to improve smoothness, printing quality and quality in terms of appearance, including adjustment of gloss. For the calendering process, various apparatuses including hard type rolls; elastic type rolls; or hard type rolls and elastic type rolls used in combination can suitably be used. These apparatuses are called machine calenders, soft nip calenders, super-calenders, multistep calenders, multi-nip calendars, and the like, and it is also possible to heat these rolls if desired. The temperature of the rolls may be from a low to middle temperature of around 40° C. up to a high temperature of around 250° C. as appropriate. It is also possible to use an apparatus in which belts and rolls are used in combination. Such apparatuses are called Shoe nip calenders, metal-belt calenders and the like, where heating, if desired, is possible. The microscopic configuration of the surfaces of these rolls are not particularly limited, and those subjected to smoothing or indenting process including specular finish, mat finish and embossing finish within the scope not impairing the properties of the present invention may be used.

In the coated printing paper of the present invention, these respective layers can be applied to both surfaces of the base paper. Applying them to both surfaces is preferable since both surfaces can be printed by a printing machine having such function.

The coated printing paper of the present invention can be used for ink jet printing, and obtain a printed image having excellent image quality and durability. The coated printing paper of the present invention can favorably be used in ink jet printing machine employing pigment ink as well, and obtain a printed image having excellent image quality and durability. The coated printing paper of the present invention can favorably be used for rotary-type ink jet printing machines having a printing speed of 15 m/min or more, those having a higher printing speed of 60 m/min or more, and those having a further higher speed of more than 120 m/min, and can produce a printed image having excellent image quality and durability.

As another embodiment of the present invention, provided is a method for improving the image quality and durability of printed images printed by ink jet printing machines, comprising the steps of obtaining the aforementioned coated printing paper, and forming a printed image on the coating layer of the coated printing paper by performing ink jet printing using pigment ink at a printing speed of 15 m/min or more. Furthermore, the present invention provides a method for forming a printed image free of rubbing-off, smudges, uneven absorption or bleeding of ink and white lines by ink jet printing, comprising the steps of obtaining the aforementioned coated printing paper, and forming a printed image on the coating layer of the coated printing paper by performing ink jet printing using pigment ink at a printing speed of 15 m/min or more. Moreover, the present invention provides a method for forming an excellent printed image, comprising the steps of obtaining the aforementioned coated printing paper, and forming a printed image on the coating layer of the coated printing paper using an ink jet printing machine.

EXAMPLE

Hereinbelow, the present invention will be more specifically explained by way of Examples, but the present invention will never be limited to the Examples below so long as the gist of the invention is not deviated. It should be noted that "part" shown in Examples refer to parts by mass of dry solid content or substantial components unless otherwise specifically indicated. Furthermore, an amount of coating refers to a dry coated amount.

(Example 1) to (Example 40) and (Comparative Example 1) to (Comparative Example 13)

According to the following content, coated printing papers were prepared. The content and number of parts blended of the undercoating layer and coating layer in the respective Examples are shown in Tables 1 and 2.

TABLE 1

| | | Undercoating layer | | | | | | | |
|---|---|---|---|---|---|---|---|---|---|
| | | | | | | Other pigments | | Binder | |
| | | Pigment A | | Pigment B | | Product | | | Water |
| | Base paper | Particle size μm | Number of parts | Particle size μm | Number of parts | name/ Particle size μm | Number of parts | Water-soluble/Number of parts | dispersible/ Number of parts |
| Example 1 | Base paper 6 | 0.19 | 100 | — | — | — | — | a/4 | c/10 |
| Example 2 | Base paper 5 | 0.19 | 100 | — | — | — | — | a/4 | c/10 |
| Example 3 | Base paper 13 | 0.19 | 100 | — | — | — | — | a/4 | c/10 |
| Example 4 | Base paper 7 | 0.19 | 100 | — | — | — | — | a/4 | c/10 |
| Example 5 | Base paper 8 | 0.19 | 100 | — | — | — | — | a/4 | c/10 |
| Example 6 | Base paper 9 | 0.19 | 100 | — | — | — | — | a/4 | c/10 |
| Example 7 | Base paper 4 | 0.19 | 100 | — | | — | — | a/4 | c/10 |
| Example 8 | Base paper 14 | 0.19 | 100 | — | | — | — | a/4 | c/10 |
| Example 9 | Base paper 10 | 2.2 | 65 | 1.4 | 35 | — | — | a/4 | c/10 |
| Example 10 | Base paper 10 | 2.2 | 20 | 1.4 | 80 | — | — | a/4 | c/10 |
| Example 11 | Base paper 10 | 2.2 | 20 | 1.4 | 80 | — | — | a/4 | c/10 |
| Example 12 | Base paper 10 | 2.2 | 20 | 1.4 | 80 | — | — | a/4 | c/10 |
| Example 13 | Base paper 10 | 2.2 | 20 | 1.4 | 80 | — | — | a/8 | c/6 |
| Example 14 | Base paper 10 | 2.2 | 20 | 1.4 | 80 | — | — | a/4 | c/10 |
| Example 15 | Base paper 10 | 2.2 | 11 | 1.4 | 80 | C/1.1 | 9 | a/4 | c/10 |
| Example 16 | Base paper 1 | 0.19 | 100 | — | — | — | — | a/4 | c/10 |
| Example 17 | Base paper 15 | 0.19 | 100 | — | — | — | — | a/4 | c/10 |
| Example 18 | Base paper 12 | 4.5 | 30 | 2.5 | 30 | D/1.3 | 40 | a/4 | c/10 |
| Example 19 | Base paper 12 | 2.2 | 20 | 1.4 | 80 | — | — | a/4 | c/10 |
| Example 20 | Base paper 12 | — | — | — | — | D/4.5/1.8 | 30/70 | a/4 | c/10 |

| | Uppermost coating layer | | | | | | | | |
|---|---|---|---|---|---|---|---|---|---|
| | | | | Colloidal | | | Water-based binder | | |
| | Undercoating layer | | Colloidal | silica composite | | | Product | | |
| | Water-soluble/Water dispersible Binder Ratio | Coated Amount g/m$^2$ | silica Number of parts | synthetic resin Number of parts | Tg ° C. | Other additives | name/ Particle size | Tg ° C. | Coated Amount g/m$^2$ |
| Example 1 | 4/10 | 4 | 100 | — | — | — | c/10 | −19 | 6 |
| Example 2 | 4/10 | 4 | 100 | — | — | — | c/10 | −19 | 6 |
| Example 3 | 4/10 | 4 | 100 | — | — | — | c/10 | −19 | 6 |
| Example 4 | 4/10 | 4 | 100 | — | — | — | c/10 | −19 | 6 |
| Example 5 | 4/10 | 4 | 100 | — | — | — | c/10 | −19 | 6 |
| Example 6 | 4/10 | 4 | 100 | — | — | — | c/10 | −19 | 6 |
| Example 7 | 4/10 | 4 | 100 | — | — | — | c/10 | −19 | 6 |
| Example 8 | 4/10 | 4 | 100 | — | — | — | c/10 | −19 | 6 |
| Example 9 | 4/10 | 5 | 100 | — | — | — | c/25 | −19 | 5 |
| Example 10 | 4/10 | 5 | 100 | — | — | — | c/25 | −19 | 5 |
| Example 11 | 4/10 | 5 | 100 | — | — | — | c/25 | −19 | 5 |
| Example 12 | 4/10 | 5 | 100 | — | — | — | c/50 | −19 | 5 |
| Example 13 | 8/6 | 5 | 100 | — | — | — | c/25 | −19 | 5 |

TABLE 1-continued

| | | | | | | | | | |
|---|---|---|---|---|---|---|---|---|---|
| Example 14 | 4/10 | 5 | 50 | — | — | E/50 | c/25 | −19 | 5 |
| Example 15 | 4/10 | 5 | 100 | — | — | — | c/25 | −19 | 5 |
| Example 16 | 4/10 | 4 | 100 | — | — | — | c/10 | −19 | 6 |
| Example 17 | 4/10 | 4 | 100 | — | — | — | c/10 | −19 | 6 |
| Example 18 | 4/10 | 5 | 100 | — | — | — | c/25 | −19 | 5 |
| Example 19 | 4/10 | 5 | 100 | — | — | — | c/25 | −19 | 5 |
| Example 20 | 4/10 | 5 | 100 | — | — | — | c/25 | −19 | 5 |

TABLE 2

| | | Undercoating layer | | | | | | | |
|---|---|---|---|---|---|---|---|---|---|
| | | | | | | Other pigments | | Binder | |
| | | Pigment A | | Pigment B | | Product | | | Water |
| | Base paper | Particle size μm | Number of parts | Particle size μm | Number of parts | name/ Particle size μm | Number of parts | Water-soluble/Number of parts | dispersible/ Number of parts |
| Example 21 | Base paper 4 | — | — | 1.4 | 100 | — | — | a/4 | c/10 |
| Example 22 | Base paper 4 | — | — | 1.4 | 100 | — | — | a/0.5 | c/10 |
| Example 23 | Base paper 4 | — | — | 1.4 | 100 | — | — | a/4 | c/10 |
| Example 24 | Base paper 4 | — | — | 1.4 | 100 | — | — | a/4 | c/10 |
| Example 25 | Base paper 4 | — | — | 1.4 | 100 | — | — | a/4 | c/10 |
| Example 26 | Base paper 4 | — | — | 1.4 | 100 | — | — | a/4 | c/10 |
| Example 27 | Base paper 4 | — | — | 1.4 | 100 | — | — | a/4 | c/10 |
| Example 28 | Base paper 4 | — | — | 1.4 | 100 | — | — | a/4 | c/10 |
| Example 29 | Base paper 4 | — | — | 1.4 | 100 | — | — | a/4 | c/10 |
| Example 30 | Base paper 4 | — | — | 1.4 | 100 | — | — | a/4 | c/10 |
| Example 31 | Base paper 4 | — | — | 1.4 | 100 | — | — | a/4 | c/10 |
| Example 32 | Base paper 4 | — | — | 1.4 | 100 | — | — | a/4 | — |
| Example 33 | Base paper 4 | — | — | 1.4 | 100 | — | — | — | c/10 |
| Example 34 | Base paper 4 | — | — | 1.4 | 100 | — | — | a/4 | d/10 |
| Example 35 | Base paper 11 | — | — | 1.4 | 100 | — | — | a/4 | c/10 |
| Example 36 | Base paper 11 | — | — | 1.4 | 100 | — | — | a/4 | c/10 |
| Example 37 | Base paper 4 | 2.2 | 20 | 1.4 | 80 | — | — | a/4 | c/10 |
| Example 38 | Base paper 4 | 2.2 | 20 | 1.4 | 80 | — | — | a/4 | c/10 |
| Example 39 | Base paper 3 | — | — | 1.4 | 100 | — | — | a/4 | c/10 |
| Example 40 | Base paper 2 | — | — | 1.4 | 100 | — | — | a/4 | c/10 |

TABLE 2-continued

| | Undercoating layer | | Uppermost coating layer | | | | | | |
|---|---|---|---|---|---|---|---|---|---|
| | | | Colloidal silica | Colloidal silica composite synthetic resin | | | Water-based binder | | |
| | Water-soluble/Water dispersible Binder Ratio | Coated Amount g/m² | Number of parts | Number of parts | Tg ° C. | Other additives | Product name/ Particle size | Tg ° C. | Coated Amount g/m² |
| Example 21 | 4/10 | 4 | — | 100 | 78 | — | c/10 | −19 | 6 |
| Example 22 | 0.5/10 | 4 | — | 100 | 78 | — | c/10 | −19 | 6 |
| Example 23 | 4/10 | 4 | — | 100 | 78 | — | c/10 | 40 | 6 |
| Example 24 | 4/10 | 4 | — | 100 | 23 | — | c/10 | −19 | 6 |
| Example 25 | 4/10 | 4 | — | 100 | 23 | — | c/10 | 27 | 6 |
| Example 26 | 4/10 | 4 | — | 100 | 23 | — | c/10 | 40 | 6 |
| Example 27 | 4/10 | 4 | — | 100 | 0 | — | c/10 | −19 | 6 |
| Example 28 | 4/10 | 4 | — | 100 | 0 | — | c/10 | 27 | 6 |
| Example 29 | 4/10 | 4 | — | 100 | 0 | — | c/10 | 40 | 6 |
| Example 30 | 4/10 | 4 | — | 100 | 78 | — | b/10 | — | 6 |
| Example 31 | 4/10 | 4 | — | 80 | 78 | B/20 | c/10 | −19 | 6 |
| Example 32 | — | 4 | — | 100 | 78 | — | c/10 | −19 | 6 |
| Example 33 | — | 4 | — | 100 | 78 | — | c/10 | −19 | 6 |
| Example 34 | 4/10 | 4 | — | 100 | 78 | — | c/10 | −19 | 6 |
| Example 35 | 4/10 | 5 | — | 100 | 55 | — | c/10 | −19 | 6 |
| Example 36 | 4/10 | 5 | — | 100 | 97 | — | c/10 | −19 | 6 |
| Example 37 | 4/10 | 5 | — | 100 | 97 | — | c/10 | −19 | 6 |
| Example 38 | 4/10 | 5 | — | 100 | 97 | — | c/10 | −19 | 6 |
| Example 39 | 4/10 | 4 | — | 100 | 78 | — | c/10 | −19 | 6 |
| Example 40 | 4/10 | 4 | — | 100 | 78 | — | c/10 | −19 | 6 |

According to the following content, coated printing papers were prepared. The content and number of parts blended of the undercoating layer and coating layer in the respective Comparative Examples are shown in Table 3.

TABLE 3

| | | Undercoating layer | | | | | | | | | |
|---|---|---|---|---|---|---|---|---|---|---|---|
| | | Pigment A | | Pigment B | | Other pigments Product name/ | | Binder | | Water-soluble/Water dispersible Binder Ratio | Coated Amount g/m² |
| | Base paper | Particle size μm | Number of parts | Particle size μm | Number of parts | Particle size μm | Number of parts | Water-soluble/ Number of parts | Water dispersible/ Number of parts | | |
| Comparative Example 1 | Base paper 16 | 0.19 | 100 | — | — | — | — | a/4 | c/10 | 4/10 | 4 |
| Comparative Example 2 | Base paper 11 | — | — | — | — | — | — | — | — | — | — |

TABLE 3-continued

| | | | | | | | | | | | |
|---|---|---|---|---|---|---|---|---|---|---|---|
| Comparative Example 3 | Base paper 1 | 0.19 | 100 | — | — | — | — | a/4 | c/10 | 4/10 | 4 |
| Comparative Example 4 | Base paper 1 | — | — | — | — | — | — | — | — | — | — |
| Comparative Example 5 | Base paper 1 | 0.19 | 100 | — | — | — | — | a/4 | c/10 | 4/10 | 4 |
| Comparative Example 6 | Base paper 16 | — | — | 1.4 | 100 | — | — | a/4 | c/10 | 4/10 | 4 |
| Comparative Example 7 | Base paper 4 | — | — | 1.4 | 100 | — | — | a/4 | c/10 | 4/10 | 4 |

| | Uppermost coating layer | | | | | | |
|---|---|---|---|---|---|---|---|
| | Colloidal silica | Colloidal silica composite synthetic resin | | | Water-based binder | | |
| | Number of parts | Number of parts | Tg ° C. | Other additives | Product name/Particle size | Tg ° C. | Coated Amount g/m$^2$ |
| Comparative Example 1 | 100 | — | — | — | c/10 | −19 | 6 |
| Comparative Example 2 | — | — | — | E/100 | — | — | 6 |
| Comparative Example 3 | — | — | — | D/100 | c/10 | −19 | 6 |
| Comparative Example 4 | 100 | — | — | — | c/10 | −19 | 6 |
| Comparative Example 5 | — | — | — | — | — | — | — |
| Comparative Example 6 | — | 100 | 78 | — | c/10 | −19 | 6 |
| Comparative Example 7 | — | — | — | — | c/10 | −19 | 6 |

(Preparation of Base Paper)

Base papers were prepared as described below. Further, the Cobb water absorption degrees of the base papers were measured as described below.

<Cobb Water Absorption Degree>

The amount of water absorbed (g/m$^2$) at a contact time of 30 seconds of the base paper surface with water was measured according to JIS P8140. Hereinbelow, "Cobb water absorption degree" refers to a Cobb water absorption degree at a contact time of 30 seconds.

(Preparation of Base Paper 1)

To a pulp slurry consisting of 100 parts of LBKP (filtrated water degree 400 mlcsf) were added, 15 parts of precipitated calcium carbonate as a filler, 0.8 part of amphoteric starch, 0.8 part of aluminium sulfate, 0.1 part of an alkylketene dimer type sizing agent (SIZE PINE K903, manufactured by Arakawa Chemical Industries, Ltd.), and paper making was performed by a Fourdrinier paper machine, and to the resultant product was applied, by a size press device, phosphate ester starch and dimethylamine-epichlorohydrin polycondensate (Jet-Fix 5052, manufactured by Satoda Chemical Industrial Co., Ltd.) as a cationic resin such that the amount of coating on both surfaces were 2 g/m$^2$ and 1.5 g/m$^2$, respectively, followed by a machine calendering process to obtain Base paper 1 having a Cobb water absorption degree of 65 g/m$^2$ and a basis weight of 93 g/m$^2$.

(Preparation of Base Paper 2)

Base paper 2 having a Cobb water absorption degree of 88 g/m$^2$ was prepared in the same manner as Base Paper 1 except that the amount of the alkylketene dimer type sizing agent of Base Paper 1 was changed to 0.08 part.

(Preparation of Base Paper 3)

Base paper 3 having a Cobb water absorption degree of 103 g/m$^2$ was prepared in the same manner as Base Paper 1 except that the amount of the alkylketene dimer type sizing agent of Base Paper 1 was changed to 0.05 part.

(Preparation of Base Paper 4)

Base paper 4 having a Cobb water absorption degree of 126 g/m$^2$ was prepared in the same manner as Base Paper 1 except that the amount of the alkylketene dimer type sizing agent of Base Paper 1 was changed to 0.03 part.

(Preparation of Base Paper 5)

Base paper 5 having a Cobb water absorption degree of 138 g/m$^2$ was prepared in the same manner as Base Paper 1 except that the amount of the alkylketene dimer type sizing agent of Base Paper 1 was changed to 0.01 part.

(Preparation of Base Paper 6)

Base paper 6 having a Cobb water absorption degree of 138 g/m$^2$ was prepared in the same manner as Base Paper 5 except that the phosphate ester starch and dimethylamine-epichlorohydrin polycondensate (Jet-Fix 5052, manufactured by Satoda Chemical Industrial Co., Ltd.) as a cationic resin were applied by the size press device of Base Paper 5 such that the amount of coating on both surfaces were 2 g/m$^2$ and 0.06 g/m$^2$, respectively.

(Preparation of Base Paper 7)

Base paper 7 having a Cobb water absorption degree of 138 g/m$^2$ was prepared in the same manner as Base Paper 5 except that the phosphate ester starch and dimethylamine-epichlorohydrin polycondensate (Jet-Fix 5052, manufactured by Satoda Chemical Industrial Co., Ltd.) as a cationic resin were applied by the size press device of Base Paper 5 such that the amount of coating on both surfaces were 1.8 g/m$^2$ and 3 g/m$^2$, respectively.

(Preparation of Base Paper 8)

Base paper 8 having a Cobb water absorption degree of 138 g/m$^2$ was prepared in the same manner as Base Paper 5 except that phosphate ester starch and dimethylamine-epichlorohydrin polycondensate (Jet-Fix 5052, manufactured by Satoda Chemical Industrial Co., Ltd.) as a cationic resin were applied by the size press device of Base Paper 5 such that the amount of coating on both surfaces were 1.8 g/m$^2$ and 9 g/m$^2$, respectively.

(Preparation of Base Paper 9)

Base paper 9 having a Cobb water absorption degree of 138 g/m$^2$ was prepared in the same manner as Base Paper 5 except that phosphate ester starch and dimethylamine-epichlorohydrin polycondensatc (Jet-Fix 5052, manufactured by Satoda Chemical Industrial Co., Ltd.) as a cationic resin were applied by the size press device of Base Paper 5 such that the amount of coating on both surfaces were 1.7 g/m$^2$ and 12 g/m$^2$, respectively.

(Preparation of Base Paper 10)

Base paper 10 having a Cobb water absorption degree of 126 g/m$^2$ was prepared in the same manner as Base Paper 4 except that phosphate ester starch and dimethylamine-epichlorohydrin polycondensate (Jet-Fix 5052, manufactured by Satoda Chemical Industrial Co., Ltd.) as a cationic resin were applied by the size press device of Base Paper 4 such that the amount of coating on both surfaces were 3 g/m$^2$ and 2 g/m$^2$, respectively.

(Preparation of Base Paper 11)

Base paper 11 having a Cobb water absorption degree of 126 g/m$^2$ was prepared in the same manner as Base Paper 4 except that phosphate ester starch and dimethylamine-epichlorohydrin polycondensate (Jet-Fix 5052, manufactured by Satoda Chemical Industrial Co., Ltd.) as a cationic resin were applied by the size press device of Base Paper 4 such that the amount of coating on both surfaces were 3 g/m$^2$ and 3.5 g/m$^2$, respectively.

(Preparation of Base Paper 12)

Base paper 12 having a Cobb water absorption degree of 65 g/m$^2$ was prepared in the same manner as Base Paper 1 except that phosphate ester starch and dimethylamine-epichlorohydrin polycondensate (Jet-Fix 5052, manufactured by Satoda Chemical Industrial Co., Ltd.) as a cationic resin were applied by the size press device of Base Paper 1 such that the amount of coating on both surfaces were 3 g/m$^2$ and 2 g/m$^2$, respectively.

(Preparation of Base Paper 13)

Base paper 13 having a Cobb water absorption degree of 138 g/m$^2$ was prepared in the same manner as Base Paper 5 except that dimethylamine-epichlorohydrin polycondensate (Jet-Fix 5052, manufactured by Satoda Chemical Industrial Co., Ltd.) as a cationic resin in Base Paper 5 was replaced by magnesium chloride as a multivalent cation salt.

(Preparation of Base Paper 14)

Base paper 14 having a Cobb water absorption degree of 126 g/m$^2$ was prepared in the same manner as Base Paper 4 except that dimethylamine-epichlorohydrin polycondensate (Jet-Fix 5052, manufactured by Satoda Chemical Industrial Co., Ltd.) as a cationic resin in Base Paper 4 was replaced by magnesium chloride as a multivalent cation salt.

(Preparation of Base Paper 15)

Base paper 15 having a Cobb water absorption degree of 65 g/m$^2$ was prepared in the same manner as Base Paper 1 except that dimethylamine-epichlorohydrin polycondensate (Jet-Fix 5052, manufactured by Satoda Chemical Industrial Co., Ltd.) as a cationic resin in Base Paper 1 was replaced by magnesium chloride as a multivalent cation salt.

(Preparation of Base Paper 16)

Base paper 16 having a Cobb water absorption degree of 126 g/m$^2$ was prepared in the same manner as Base Paper 4 except that no cationic resin was applied in Base Paper 4.

(Preparation of Coating Colour for Undercoating Layer)

Pigment: the content and number of parts blended are shown in Tables 1 to 3

Water-soluble binder: the content and number of parts blended are shown in Tables 1 to 3

Water dispersible binder: the content and number of parts blended are shown in Tables 1 to 3

Coating colours for undercoating layers were blended as shown above, and mixed with and dispersed in water so as to have a concentration of 50 mass % in teams of solid content.

(Preparation of Coating Colour for Uppermost Coating Layer)

Colloidal silica: the content and number of parts blended are shown in Tables 1 to 3

(Note that, however, as for "colloidal silica composite synthetic resin", the number of parts refers to the number of parts blended as colloidal silica composite synthetic resin.)

Pigments other than colloidal silica:

the content and number of parts blended are shown in Tables 1 to 3

Binder: the content and number of parts blended are shown in Tables 1 to 3

Coating colours for uppermost coating layers were blended as stated above, and mixed with and dispersed in water so as to have a concentration of 30 mass % in terms of solid content. As the synthetic resins included in colloidal silica composite synthetic resins, vinyltriethoxysilane was used as monomers having a silyl group, and styrene and butyl acrylate were used as monomers having no silyl group. Tg was adjusted by the blend ratio of styrene and butyl acrylate as monomers having no silyl group. As for the colloidal silica included in the colloidal silica composite synthetic resin, colloidal silica having a mean particle size of 30 nm was used. The mass ratio of the colloidal silica included in the colloidal silica composite synthetic resin to the synthetic resin was colloidal silica/synthetic resin=60/40, and the mean particle size of the colloidal silica composite synthetic resin was 150 nm.

The pigments and binders shown in abbreviation in Tables 1 to 3 are as follows:

Pigment A: kaolin

Pigment B: ground calcium carbonate

Pigment C: styrene-based plastic pigments

Pigment D: synthesized amorphous silica

Pigment E: styrene acrylic copolymer

Binder a: phosphate ester starch

Binder b: polyvinyl alcohol

Binder c: styrene-butadiene copolymer

Binder d: methylmethacrylate-butadiene copolymer (Preparation of Coated Printing Paper)

To a base paper was applied a coating colour for the undercoating layer using a blade coater and dried, then a coating colour for the uppermost coating layer was applied using air knife coater. Thereafter, the paper was subjected to a calendering process for smoothing. In Examples 1 to 8, 16, 17, 21 to 34, 39 and 40 and Comparative Examples 1, 3 and 5 to 7, the applied amount per surface of the undercoating layer and the uppermost coating layer were 4 g/m$^2$ and 6 g/m$^2$, respectively. In Examples 9 to 15, 18 to 20, the applied amount per surface of the undercoating layer and the uppermost coating layer were 5 g/m$^2$ and 5 g/m$^2$, respectively. In Examples 35 to 38, the applied amount of coating per surface of the undercoating layer and the uppermost coating layer were 5 g/m$^2$ and 6 g/m$^2$, respectively. In Comparative Examples 2 and 4, the applied amount per surface of the uppermost coating layer was 6 g/m$^2$. In Examples 11 and 38, the undercoating layer and the coating layer were applied on both surfaces of the base paper, and in other Examples, the undercoating layer and the coating layer were applied on one surface of the base paper. Calendering was performed using an apparatus comprising an elastic roll and a metal roll, and nip linear pressure was applied at 80 kN/m within the range where the thickness profile in the cross direction was suitably obtained. In addition, the temperature of the metal roll was 40° C.

For Comparative Example 8, commercially available ink jet printer-exclusive gloss photo paper (IJ-UF-120, manufactured by Mitsubishi Paper Mills Limited), for Comparative Example 9, commercially available ink jet printer-exclusive gloss paper (IJ-CastCoat150J, manufactured by Mitsubishi Paper Mills Limited), for Comparative Example 10, commercially available exclusive paper for ink jet printer (IJ-MatteCoat90, manufactured by Mitsubishi Paper Mills Limited), for Comparative Example 11, commercially available coated printing paper (Pearl Coat N, ream weight of 73 kg, manufactured by Mitsubishi Paper Mills Limited), for Comparative Example 12, commercially available printing paper (Mitsubishi IJ form PD, 81.4 g/m$^2$, manufactured by Mitsubishi Paper Mills Limited), for Comparative Example 13, commercially available coated printing paper (Aurora Coat, ream weight of 73 kg, manufactured by Nippon Paper Industries Co., Ltd.) were used. It should be noted that these commercially available exclusive papers for ink jet printers and coated printing papers contain no cationic resin nor multivalent metal ion salt in their base papers. Alternatively, the aforementioned commercially available printing papers have no coating layer containing colloidal silica.

(Evaluation of Coated Printing Papers)

Coated printing papers were evaluated by the following methods.

Printing machine TruepressJet520 manufactured by Dainippon Screen MFG. Co., Ltd. was used for ink jet printing machine. Printing was performed at a print feeding speed of 128 m per minute.

<Evaluation of Gloss Degree>

Sheet gloss degrees of the coated printing papers were measured according to JIS Z8741, using GM-26D digital glossmeter manufactured by Murakami Color Research Laboratory Co., Ltd. at an incidence/reflection angle of 75°. A gloss of 40% or more would suffice as a gloss coated printing paper, and the gloss is preferably 60% to 90% as an excellent gloss coated printing paper.

<Evaluation of Ink Fixing Property>

The printed surfaces of the coated printing papers ejected at a predetermined feeding speed to a paper ejecting part of the printing machine were observed, and the trace of ink rub-off and degree of ink detachment were determined by visual evaluation. Those rated "3 to 5" in evaluation have no practical problem.

5: No trace of ink rubbing off nor detachment of ink is observed

4: Virtually no trace of ink rubbing off nor detachment of ink is observed

3: A slight trace of ink rubbing off and a very little detachment of ink are observed 2: There is a trace of ink rubbing off and the printed matter partially looks smudged.

1: There is a trace of ink rubbing off and detachment of ink across the printed portion.

<Evaluation of Abrasion Resistance Property of Printed Portion>

A solid image with an image size of 18 cm×18 cm was printed with a black ink on coated printing papers. One hour after the printing, a friction test was carried out for 25 times by pressing a cotton gauze with a load of 500 g or 300 g against the printed surfaces of the coated printing papers, the pressed area being 4 cm$^2$, and evaluation was made visually according to the following criteria. Those rated "3 to 5" in evaluation have no practical problem.

5: Almost no scar at all is observed with the load of 500 g.

4: Slight scars are observed when tested with the load of 500 g, but are acceptable level.

3: Slight scars are observed when tested with the load of 300 g, but are acceptable level.

2: Some scars are observed when tested with the load of 300 g.

1: Noticeable scars are observed when tested with the load of 300 g.

<Evaluation of Ink Adhesive Strength>

One hour after the printing, the printed surfaces of the coated printing papers were scratched with nails, and adhesive strength of the ink was evaluated by visual evaluation using a scale of 5 to 1 as shown below. Those rated "3 to 5" in evaluation have no practical problem.

5: No detachment of ink

4: Almost no detachment of ink

3: Slight detachment but no practical problem

2: Detachment is observed to the extent that the printed matter cannot be practically used 1: Detachment easily occurs and the printed matter cannot be used <Evaluation of Ink Absorption>

Using a printing machine, a solid printing was performed on coated printing papers employing a method of printing seven color solid patterns, consisting of black, cyan, magenta, yellow (each as a single color) and colors (red, green, blue) created by superimposing two colors out of the three colors of the aforementioned colors other than black, each being 2 cm×2 cm in size, and being arranged horizontally side by side with no gap inbetween. The solid portion and edge portion of each color in the printed portions were determined by visual evaluation. Those rated "3 to 5" in evaluation have no practical problem.

5: No bleeding in color edge portions

4: Virtually no bleeding in color edge portions

3: While there are bleeding in color edge portions, the edge portions are clearly distinguished from one another.

2: There is no clear color edge portions, and colors are slightly moved into adjacent color portions crossing the edge portions.

1: The edges of respective colors are not recognizable and bleeding of colors into the adjacent colors are significant.

<Evaluation of Inhibition of Poor Dot Diffusion>

A solid image with a black ink of 18 cm×18 cm image size was printed on coated printing papers. Degree of visibility of white lines due to poor dot diffusion of ink droplets was visually evaluated. Those rated "3 to 5" in evaluation have no practical problem.

5: No white lines are observed.

4: Although no white lines are observed, uneven density is observed.

3: Although no white lines are observed, slight stitching is observed.

2: Vague white lines are observed.

1: White lines are clearly observed.

The evaluation results of printing using coated printing papers of Examples 1 to 40 and Comparative Examples 1 to 13 are shown in Table 4 and Table 5.

TABLE 4

| | | | TruepressJet520 | | | | |
|---|---|---|---|---|---|---|---|
| | Printing speed m/min | 75° gloss % | Ink fixing property | Abrasion resistance property of printed portion | Ink adhesive strength | Ink absorption property | Inhibition of poor dot diffusion |
| Example 1 | 128 | 70 | 3 | 3 | 3 | 3 | 3 |
| Example 2 | 128 | 71 | 3 | 3 | 3 | 4 | 4 |
| Example 3 | 128 | 68 | 3 | 3 | 3 | 4 | 4 |
| Example 4 | 128 | 70 | 4 | 3 | 3 | 4 | 4 |
| Example 5 | 128 | 69 | 4 | 3 | 3 | 4 | 4 |
| Example 6 | 128 | 68 | 4 | 3 | 3 | 4 | 4 |
| Example 7 | 128 | 71 | 3 | 3 | 3 | 4 | 4 |
| Example 8 | 128 | 68 | 3 | 3 | 3 | 4 | 4 |
| Example 9 | 128 | 70 | 4 | 3 | 3 | 3 | 4 |
| Example 10 | 128 | 67 | 4 | 4 | 3 | 4 | 4 |
| Example 11 | 128 | 67 | 4 | 4 | 3 | 4 | 4 |
| Example 12 | 128 | 69 | 4 | 4 | 3 | 3 | 3 |
| Example 13 | 128 | 68 | 3 | 4 | 3 | 3 | 4 |
| Example 14 | 128 | 69 | 3 | 3 | 3 | 4 | 4 |
| Example 15 | 128 | 75 | 4 | 4 | 3 | 4 | 4 |
| Example 16 | 128 | 72 | 3 | 3 | 3 | 3 | 3 |
| Example 17 | 128 | 69 | 3 | 3 | 3 | 3 | 3 |
| Example 18 | 128 | 50 | 4 | 3 | 4 | 4 | 3 |
| Example 19 | 128 | 67 | 4 | 4 | 3 | 3 | 4 |
| Example 20 | 128 | 48 | 4 | 4 | 4 | 4 | 3 |
| Example 21 | 128 | 72 | 4 | 4 | 4 | 5 | 4 |
| Example 22 | 128 | 73 | 4 | 4 | 4 | 4 | 4 |
| Example 23 | 128 | 75 | 4 | 3 | 4 | 4 | 4 |
| Example 24 | 128 | 74 | 3 | 4 | 4 | 3 | 4 |
| Example 25 | 128 | 76 | 3 | 4 | 3 | 3 | 3 |
| Example 26 | 128 | 75 | 3 | 4 | 3 | 3 | 3 |

TABLE 5

| | | | TruepressJet520 | | | | |
|---|---|---|---|---|---|---|---|
| | Printing speed m/min | 75° gloss % | Ink fixing property | Abrasion resistance property of printed portion | Ink adhesive strength | Ink absorption property | Inhibition of poor dot diffusion |
| Example 27 | 128 | 75 | 3 | 4 | 3 | 3 | 4 |
| Example 28 | 128 | 77 | 3 | 3 | 3 | 3 | 3 |
| Example 29 | 128 | 76 | 3 | 3 | 3 | 3 | 3 |
| Example 30 | 128 | 70 | 3 | 5 | 5 | 4 | 3 |
| Example 31 | 128 | 73 | 4 | 4 | 5 | 4 | 4 |
| Example 32 | 128 | 72 | 4 | 4 | 4 | 4 | 3 |
| Example 33 | 128 | 73 | 4 | 4 | 4 | 4 | 4 |
| Example 34 | 128 | 73 | 4 | 3 | 4 | 4 | 4 |
| Example 35 | 128 | 75 | 4 | 4 | 4 | 4 | 4 |
| Example 36 | 128 | 74 | 4 | 4 | 4 | 5 | 4 |
| Example 37 | 128 | 76 | 4 | 5 | 4 | 5 | 5 |
| Example 38 | 128 | 76 | 4 | 5 | 4 | 5 | 5 |
| Example 39 | 128 | 73 | 4 | 4 | 4 | 5 | 4 |
| Example 40 | 128 | 74 | 4 | 4 | 4 | 4 | 4 |
| Comparative Example 1 | 128 | 70 | 2 | 2 | 2 | 2 | 2 |
| Comparative Example 2 | 128 | 65 | 1 | 1 | 2 | 1 | Failed to absorb |
| Comparative Example 3 | 128 | 9 | 5 | 3 | 5 | 5 | 1 |
| Comparative Example 4 | 128 | 68 | 2 | 3 | 3 | 2 | 3 |
| Comparative Example 5 | 128 | 45 | 1 | 2 | 1 | 2 | 2 |
| Comparative Example 6 | 128 | 72 | 2 | 3 | 2 | 2 | 2 |
| Comparative Example 7 | 128 | 32 | 1 | 1 | 1 | 2 | 2 |
| Comparative Example 8 | 128 | 66 | 5 | 4 | 4 | 5 | 1 |
| Comparative Example 9 | 128 | 72 | 4 | 1 | 1 | 4 | 2 |

TABLE 5-continued

| | Printing speed m/min | 75° gloss % | TruepressJet520 Ink fixing property | Abrasion resistance property of printed portion | Ink adhesive strength | Ink absorption property | Inhibition of poor dot diffusion |
|---|---|---|---|---|---|---|---|
| Comparative Example 10 | 128 | 8 | 5 | 5 | 5 | 5 | 2 |
| Comparative Example 11 | 128 | 76 | 1 | 1 | 1 | 1 | 1 |
| Comparative Example 12 | 128 | 3 | 5 | 5 | 5 | 4 | 5 |
| Comparative Example 13 | 128 | 76 | 1 | 1 | 1 | 1 | 1 |

As shown in Table 4, coated printing papers of Examples 1 to 40 of the present invention are excellent in ink fixing property and ink absorption property, and also in inhibition of poor dot diffusion, and further have an abrasion resistance property and an ink adhesion property. It is understood, from the comparison between Examples 1 to 20 with Examples 21 to 40, that it is more preferred that the uppermost coating layer contains a colloidal silica composite synthetic resin. In particular, it is understood that it is more preferred that the Tg of the synthetic resin included in the colloidal silica composite synthetic resin is 50° C. or more, or that the Tg of the water dispersible binder is lower than the Tg of the synthetic resin included in the colloidal silica composite synthetic resin.

As shown in Table 5, since the base papers do not contain any one or more selected from a cationic resin or a multivalent cation salt, or since the uppermost coating layers contain no colloidal silica, or since there exists no undercoating layer in coated printing papers of Comparative Examples 1 to 7, the effects of the present invention were not achieved. Furthermore, with commercially available exclusive papers for ink jet printers or commercially available coated printing papers, the effects of the present invention were not achieved.

(Example 41) to (Example 44) and (Comparative Example 14) to (Comparative Example 18)

According to the following content, coated printing papers were prepared. The contents of undercoating layer or coating layer and number of parts blended of respective Examples and Comparative Examples are shown in Table 6.

TABLE 6

| | Base paper | Pigment in coating colour for uppermost layer A | B | C | D | E | Binder in coating colour for uppermost layer A | B | C |
|---|---|---|---|---|---|---|---|---|---|
| Example 41 | Base paper 12 | 100 | | | | | 10 | | |
| Example 42 | Base paper 12 | | | 100 | | | | | 10 |
| Example 43 | Base paper 10 | | | 100 | | | 10 | | |
| Example 44 | Base paper 12 | | | 100 | | | 10 | | |
| Comparative Example 14 | Base paper 10 | | | | 50 | 50 | 25 | | |
| Comparative Example 15 | Base paper 10 | | | | 50 | 50 | 5 | | |

TABLE 6-continued

| | Base paper | Pigment in coating colour for uppermost layer A | B | C | D | E | Binder in coating colour for uppermost layer A | B | C |
|---|---|---|---|---|---|---|---|---|---|
| Comparative Example 16 | Base paper 10 | | 100 | | | | | 67 | |
| Comparative Example 17 | Commercial CWF gloss coated printing paper | | | | | | | | |
| Comparative Example 18 | Commercial ink jet printer - exclusive gloss paper | | | | | | | | |

The aforementioned Base Paper 10 or Base Paper 12 were used as base papers.

(Preparation of Coating Colour for Undercoating Layer 1)

20 parts of kaolin (mean particle size of 2.2 μm), 80 parts of ground calcium carbonate (mean particle size of 1.4 μm), 10 parts of styrene-butadiene copolymer (Tg: −19° C.) latex and 4 parts of phosphate ester starch were blended, and the mixture was adjusted with an ammonia solution so as to have a pH of 9.5, and adjusted with water so as to have a Brookfield type viscosity of 200 to 600 mPa·s to obtain a Coating colour 1 for forming undercoating layer.

(Preparation of Coating Colour for Undercoating Layer 2)

20 parts of kaolin (mean particle size of 2.2 μm), 80 parts of ground calcium carbonate (mean particle size of 2.5 μm), 10 parts of styrene-butadiene copolymer (Tg: −19° C.) latex and 4 parts of phosphate ester starch were blended, and the mixture was adjusted with an ammonia solution so as to have a pH of 9.5, and adjusted with water so as to have a Brookfield type viscosity of 200 to 600 mPa·s to obtain a coating colour 2 for forming undercoating layer.

(Preparation of Coating Colour for Uppermost Coating Layer)

Pigment: the content and number of parts blended are shown in Table 6

Binder: the content and number of parts blended are shown in Table 6

The pigments and binders shown in abbreviation in Table 6 are as follows:

Pigment F: colloidal silica (mean particle size of 12 nm)

Pigment G: colloidal silica (mean particle size of 20 to 30 nm)

Pigment H: colloidal silica composite synthetic resin (the same colloidal silica composite synthetic resin as Example 36 was used)

Pigment I: polystyrene-based organic pigment (mean particle size of 1 μm, void rate of 50 volume %)

Pigment J: kaolin (mean particle size of 2.2 μm)

Binder e: styrene-butadiene copolymer (glass transition temperature of −19° C.)

Binder f: styrene acrylic copolymer

Binder g: polyvinyl alcohol (degree of saponification: 98%, average degree of polymerization: 400)

Coated printing papers of Examples 41 to 44 and Comparative Examples 14 to 16 were prepared according to the following procedure. Furthermore, as Comparative Example 17, commercially available CWF gloss coated printing paper (Pearl Coat N, ream weight 73 kg, manufactured by Mitsubishi Paper Mills Limited) and as Comparative Example 18, commercially available ink jet printer-exclusive gloss paper (IJ-CastCoat150J, manufactured by Mitsubishi Paper Mills Limited) were used.

(Preparation of Coated Printing Paper)

A coating colour for an undercoating layer was applied on base papers by a blade coater such that the applied amount per surface was 5 g/m$^2$. After drying, a calendering process was performed to form an undercoating layer. Then, on the undercoating layer, a coating colour for an uppermost coating layer was applied by an air knife coater on one surface such that the applied amount per surface was 6 g/m$^2$. After drying, a calendering process was performed to form a coated printing paper. Here, for Comparative Example 15, Coating colour 2 for an undercoating layer was used, and for others, Coating colour 1 for undercoating layer was used. For Comparative Example 16, no undercoating layer was provided.

Evaluations of coated printing papers other than the measurements of contact angles and remaining droplet volumes were made according to the aforementioned methods. Contact angles and remaining droplet volume fractions were measured according to the following methods.

<Measurement of Contact Angle and Remaining Droplet Volume Fraction>

Measurement of contact angles and remaining droplet volume fractions were conducted by dropping 1 μl of a mixture solution (deionized water/glycerine=8/2) on the coating layers of coated printing papers, followed by image data analysis at each predetermined contact time using an automatic contact angle meter, CA-VP300 (manufactured by Kyowa Interface Science Co., Ltd.) and an image analysis software, FAMAS (manufactured by Kyowa Interface Science Co., Ltd.). The image data analysis was performed by a curve fitting method. The mixture solution (deionized water/glycerine=8/2) used for the measurement was obtained by mixing deionized water and glycerine at a mass ratio of deionized water/glycerine=8/2, and further adding to the mixture a surfactant to adjust the surface tension to 27.5 mN/m.

The results of measurements of these contact angles and remaining droplet volume fractions, as well as respective evaluation results are shown in Table 7.

TABLE 7

| | Contact angle measurement results (°) | | Remaining droplet volume fraction measurement results (%) | | Evaluation results | | | | | |
|---|---|---|---|---|---|---|---|---|---|---|
| | After 0.1 second | After 1.5 seconds | After 1.5 seconds | After 10 seconds | 75° gloss (%) | Ink fixity property | Abrasion resistance property of printed portion | Ink Adhesive strength | Ink absorption property | Inhibition of poor dot diffusion |
| Example 41 | 72 | 33 | 84 | 67 | 72 | 3 | 3 | 4 | 4 | 4 |
| Example 42 | 84 | 44 | 98 | 84 | 68 | 3 | 4 | 4 | 4 | 3 |
| Example 43 | 61 | 26 | 87 | 63 | 72 | 4 | 4 | 4 | 5 | 4 |
| Example 44 | 74 | 40 | 92 | 73 | 74 | 4 | 4 | 4 | 4 | 4 |
| Comparative Example 14 | 89 | 48 | 88 | 75 | 71 | 2 | 2 | 2 | 2 | 2 |
| Comparative Example 15 | 54 | 40 | 66 | 60 | 70 | 2 | 3 | 3 | 2 | 2 |
| Comparative Example 16 | 88 | 55 | 90 | 88 | 62 | 3 | 3 | 2 | 2 | 2 |
| Comparative Example 17 | 101 | 92 | 88 | 92 | 76 | 1 | 1 | 1 | 1 | Failed to absorb |
| Comparative Example 18 | 37 | 17 | 56 | 49 | 72 | 3 | 4 | 3 | 2 | 2 |

As shown in Table 7, Examples 41 to 44 where the contact angle of the uppermost coating layer is within the range of the present invention showed excellent ink jet printability. By comparing Example 42 with Example 43 or with Example 44, it is understood that as long as the remaining droplet volume fractions are within the range of the present invention, a more excellent ink fixing property and inhibition of poor dot diffusion can be achieved.

On the other hand, Comparative Examples 14 and 15 where the contact angle and remaining droplet volume fraction of the uppermost coating layer from the base paper are not within the range of the present invention cannot achieve the effects of the present invention. Furthermore, according to Comparative Examples 17 and 18, the contact angle and remaining droplet volume fraction of commercially available CWF gloss coated printing paper and of commercially available ink jet printer-exclusive gloss paper are not within the range of the present invention, and the effect of the present invention cannot be achieved.

The invention claimed is:

1. A coated printing paper comprising a base paper, an undercoating layer which is applied on at least one surface of the base paper and contains a pigment and a binder, and one or more coating layers on the undercoating layer, wherein the base paper contains at least one selected from a cationic resin and a multivalent cation salt, and an uppermost coating layer contains at least a colloidal silica, and a 75° gloss according to JIS Z8741 of a surface of the uppermost coating layer is 40% or more, the colloidal silica contained in the uppermost coating layer includes a colloidal silica composite synthetic resin, and the binder contained in the uppermost coating layer is a water dispersible binder, and a glass transition temperature of the water dispersible binder is lower than the glass transition temperature of the synthetic resin included in the colloidal silica composite synthetic resin, wherein the coated printing paper is used for a printing machine employing ink jet recording system.

2. The coated printing paper according to claim 1, wherein the base paper has a Cobb water absorption degree according to JIS P8140 of 60 $g/m^2$ or more at a contact time of 30 seconds.

3. The coated printing paper according to claim 1, wherein a glass transition temperature of the synthetic resin included in the colloidal silica composite synthetic resin is 50° C. or more.

4. The coated printing paper according to claim 2, wherein a glass transition temperature of the synthetic resin included in the colloidal silica composite synthetic resin is 50° C. or more.

* * * * *